US011473593B2

(12) United States Patent
Kim et al.

(10) Patent No.: US 11,473,593 B2
(45) Date of Patent: Oct. 18, 2022

(54) BLOWER COMPRISING A FAN INSTALLED IN AN INNER SPACE OF A LOWER BODY HAVING A FIRST AND SECOND UPPER BODY POSITIONED ABOVE AND A SPACE FORMED BETWEEN THE BODIES WHEREIN THE BODIES HAVE A FIRST AND SECOND OPENINGS FORMED THROUGH RESPECTIVE BOUNDARY SURFACES WHICH ARE OPENED AND CLOSED BY A DOOR ASSEMBLY

(71) Applicant: LG ELECTRONICS INC., Seoul (KR)

(72) Inventors: Jaehyun Kim, Seoul (KR); Yongmin Kim, Seoul (KR); Kidong Kim, Seoul (KR); Seokho Choi, Seoul (KR); Hyungho Park, Seoul (KR); Hoojin Kim, Seoul (KR); Chiyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 28 days.

(21) Appl. No.: 17/190,692

(22) Filed: Mar. 3, 2021

(65) Prior Publication Data

US 2021/0277913 A1 Sep. 9, 2021

(30) Foreign Application Priority Data

Mar. 4, 2020 (KR) ..... 10-2020-0027278
Jun. 2, 2020 (KR) ..... 10-2020-0066278
(Continued)

(51) Int. Cl.
*F04D 29/44* (2006.01)
*F04D 29/00* (2006.01)
(Continued)

(52) U.S. Cl.
CPC ..... *F04D 29/441* (2013.01); *F04D 29/002* (2013.01); *F04D 29/26* (2013.01);
(Continued)

(58) Field of Classification Search
CPC ..... F04D 25/14; F04D 29/464; F04D 29/002; F04D 29/26; F04D 29/403; F04D 29/441;
(Continued)

(56) References Cited

U.S. PATENT DOCUMENTS 1,787,062 A * 12/1930 Anderson ..... F04D 29/464 251/118
7,059,826 B2 * 6/2006 Lasko ..... F04D 29/444 416/126
(Continued)

FOREIGN PATENT DOCUMENTS

CN 105221462 1/2016
CN 01/12/2018 1/2018
(Continued)

OTHER PUBLICATIONS

U.S. Appl. No. 17/191,873, filed Mar. 4, 2021.
(Continued)

*Primary Examiner* — Kenneth J Hansen
*Assistant Examiner* — Benjamin Doyle
(74) *Attorney, Agent, or Firm* — KED & Associates

(57) ABSTRACT

A blower is provided that may include a fan that creates airflow; a lower body forming an inner space in which the fan may be installed, and having at least one suction hole through which air passes; an upper body positioned above the lower body and including a first upper body forming a first inner space that communicates with the inner space of the lower body, and a second upper body forming a second inner space that communicates with the inner space of the lower body and spaced apart from the first upper body; a
(Continued)

space formed between the first upper body and the second upper body and opened in a frontward-rearward direction; a first opening formed through a first boundary surface of the first upper body facing the space; a second opening formed through a second boundary surface of the second upper body facing the space; and a door assembly including a first door installed at the first upper body and that opens and closes the first opening, and a second door installed at the second upper body and that opens and closes the second opening.

20 Claims, 27 Drawing Sheets

(30) Foreign Application Priority Data

Jun. 2, 2020 (KR) ..... 10-2020-0066279
Jun. 2, 2020 (KR) ..... 10-2020-0066280

(51) Int. Cl.
*F04D 29/26* (2006.01)
*F04D 29/40* (2006.01)
*F04D 29/46* (2006.01)
*F04D 25/08* (2006.01)
*F04F 5/16* (2006.01)
*F04F 5/46* (2006.01)

(52) U.S. Cl.
CPC ..... *F04D 29/403* (2013.01); *F04F 5/16* (2013.01); *F04D 25/08* (2013.01); *F04D 29/464* (2013.01); *F04F 5/461* (2013.01)

(58) Field of Classification Search
CPC .. F04D 25/08; F04D 25/10; F04F 5/16; F04F 5/44; F04F 5/461; F04F 5/50; F04F 5/46; F04F 5/467; F05D 2250/52; F05B 2240/12; F24F 13/1413; F24F 2013/1446; F24F 13/15; F24F 13/16
USPC ..... 417/313, 182, 187
See application file for complete search history.

(56) References Cited

U.S. PATENT DOCUMENTS 7,088,913 B1 * 8/2006 Verhoorn ..... F24H 3/0411 392/360
7,934,387 B2 * 5/2011 Lee ..... F24F 1/0063 62/428
8,002,868 B2 * 8/2011 Kim ..... F24F 13/20 55/498
8,967,980 B2 * 3/2015 Fitton ..... F04D 27/00 417/178
9,989,275 B2 * 6/2018 Oe ..... B60H 1/3421
10,094,392 B2 * 10/2018 Poulton ..... F04D 25/08
10,260,521 B2 * 4/2019 Barclay ..... F04F 5/16
10,260,529 B2 * 4/2019 Hughes ..... F04D 29/703
11,007,464 B1 * 5/2021 Landy ..... F24F 8/10
11,022,146 B2 * 6/2021 Mogridge ..... F04D 29/547
11,326,612 B2 * 5/2022 De' Longhi ..... F04D 29/541
2001/0031137 A1 * 10/2001 Jones-Lawlor ..... F04D 25/166 392/367
2004/0120815 A1 * 6/2004 Lasko ..... F24H 3/0417 415/213.1
2005/0031448 A1 * 2/2005 Lasko ..... F24H 3/0417 415/213.1
2005/0053465 A1 * 3/2005 Roach ..... F04D 25/10 416/101
2006/0172682 A1 * 8/2006 Orr ..... F04D 29/283 454/152
2006/0199515 A1 * 9/2006 Lasko ..... F24F 7/065 454/237
2009/0120925 A1 * 5/2009 Lasko ..... F24H 3/0411 219/386
2010/0226801 A1 * 9/2010 Gammack ..... F04D 25/08 417/423.1
2012/0034108 A1 * 2/2012 Wallace ..... F04D 29/5826 417/313
2012/0051884 A1 3/2012 Junkel et al.
2013/0243588 A1 * 9/2013 Lo ..... F04D 29/547 415/182.1
2014/0302769 A1 * 10/2014 Sawada ..... F24F 13/082 454/315
2015/0136997 A1 * 5/2015 Kubo ..... H01J 27/022 417/76
2017/0191692 A1 * 7/2017 Hwang ..... F24F 13/20
2018/0087797 A1 * 3/2018 Han ..... F24F 11/70
2020/0173445 A1 * 6/2020 Kono ..... F24F 1/0022
2022/0065263 A1 * 3/2022 Kosaka ..... F04D 29/4213

FOREIGN PATENT DOCUMENTS

FR 3075111 6/2019
JP 2013-015114 A * 1/2013 ..... F04F 5/48
JP 2015-152005 8/2015
JP 2015-152005 A * 8/2015 ..... F04F 5/46
JP 2016-000967 A * 1/2016 ..... F04F 5/44
JP 2017-172358 9/2017
KR 20-2009-0006342 6/2009
KR 10-2011-0099318 9/2011
KR 10-2011-0100274 9/2011
KR 10-1331487 11/2013
KR 101472758 B1 * 2/2014 ..... F04D 25/08
KR 10-2018-0068650 6/2018
KR 10-2018-0125425 11/2018
KR 10-2018-0128282 12/2018
KR 10-2019-0015325 2/2019
KR 10-2019-0025443 3/2019
WO WO 2013/035271 3/2013
WO WO-2013035271 A1 * 3/2013 ..... F04D 25/10

OTHER PUBLICATIONS

European Search Report dated Jul. 27, 2021 issued in Application No. 21160594.4.
European Search Report dated Jul. 27, 2021 issued in Application No. 21160599.3.
Korean Office Action dated Oct. 27, 2021 issued in Application No. 10-2020-0057727.
Korean Notice of Allowance dated Jan. 21, 2022 issued in Application No. 10-2020-0057727.

* cited by examiner

BLOWER COMPRISING A FAN INSTALLED IN AN INNER SPACE OF A LOWER BODY HAVING A FIRST AND SECOND UPPER BODY POSITIONED ABOVE AND A SPACE FORMED BETWEEN THE BODIES WHEREIN THE BODIES HAVE A FIRST AND SECOND OPENINGS FORMED THROUGH RESPECTIVE BOUNDARY SURFACES WHICH ARE OPENED AND CLOSED BY A DOOR ASSEMBLY

CROSS-REFERENCE TO RELATED APPLICATION(S)

This application claims the priority benefit of Korean Patent Application No. 10-2020-0027278, filed in Korea on Mar. 4, 2020, Korean Patent Application No. 10-2020-0066278, filed in Korea on Jun. 2, 2020, Korean Patent Application No. 10-2020-0066279, filed in Korea on Jun. 2, 2020, and Korean Patent Application No. 10-2020-0066280, filed in Korea on Jun. 2, 2020, the entire disclosures of all of which are hereby expressly incorporated by reference into the present application.

BACKGROUND

1. Field

A blower is disclosed herein.

2. Background

A blower may cause a flow of air to circulate in an indoor space or form airflow toward a user. Recently, many studies have been conducted on an air discharge structure of the blower that may give the user a sense of comfort. In this regard, Korean Patent Nos. 2011-0099318, 2011-0100274, 2019-0015325, and 2019-0025443 disclose a fan or a blowing device for blowing air using a coanda effect.

A conventional blowing device has a plurality of motors individually driven for controlling a blowing intensity or a blowing direction, or it is necessary to move or rotate the blowing device itself for controlling the blowing intensity or the blowing direction. For this reason, there are problems that it is difficult to control the blowing intensity or the blowing direction effectively and step by step, or excessive power consumption.

BRIEF DESCRIPTION OF THE DRAWINGS

Embodiments will be described in detail with reference to the following drawings in which like reference numerals refer to like elements, and wherein.

DETAILED DESCRIPTION

Figure 1:
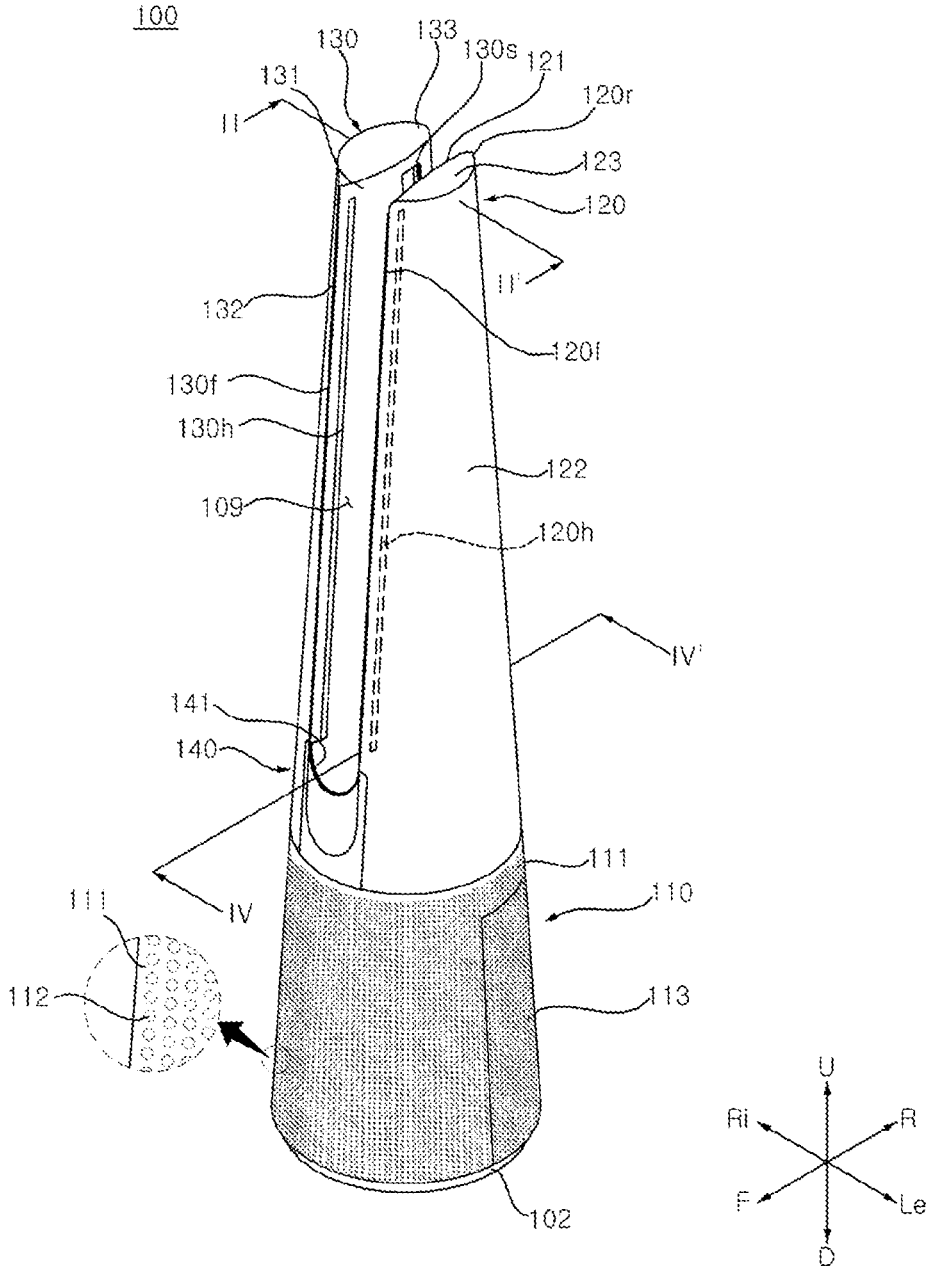
FIG. 1 is a perspective view of a blower according to an embodiment.

Hereinafter, embodiments will be described with reference to the accompanying drawings. Identical or similar elements are denoted by the same or similar reference numerals, and redundant description thereof has been omitted.

In describing embodiments, when it is determined that description of related known technologies may obscure the subject matter of the embodiments disclosed, the description thereof has been omitted. In addition, the accompanying drawings are for easy understanding of embodiments, and the technical idea disclosed is not limited by the accompanying drawings, and it is to be understood as including all changes, equivalents, and substitutes included in the spirit and technical scope.

Terms including ordinal numbers, such as first and second, may be used to describe various elements, but the elements are not limited by the terms. The terms are used only for the purpose of distinguishing one component from another component.

Direction indications of up U, down D, left Le, right Ri, front F, and rear R shown in the drawings are for convenience of description only, and the disclosed technical idea is not limited by these.

Referring to FIG. 1, a blower 100 may be elongated lengthwise in an upward-downward or vertical direction. The blower 100 may include a base 102, a lower body 110, a first upper body 120, and a second upper body 130. The base 102 may form a lower surface of the blower 100 and may be placed on a floor of an indoor space. The base 102 may be formed in a circular plate shape as a whole, for example.

The lower body 110 may be disposed above the base 102. The lower body 110 may form a lower side of the blower 100. The lower body 110 may be formed in a cylindrical shape as a whole, for example. For example, a diameter of the lower body 110 may decrease from a lower portion to an upper portion of the lower body 110. For another example, the diameter of the lower body 110 may be kept constant in the vertical direction. A suction hole 112 may be formed to pass through a side surface of the lower body 110. For example, a plurality of suction holes 112 may be evenly disposed along a circumferential direction of the lower body 110. As a result, air may flow from an outside to an inside of the blower 100 through the plurality of suction holes 112.

The first upper body 120 and the second upper body 130 may be disposed above the lower body 110. The first upper body 120 and the second upper body 130 may form an upper side of the blower 100. The first upper body 120 and the second upper body 130 may extend lengthwise in the vertical direction and may be spaced apart from each other in a left-right or lateral direction. A space 109 may be formed between the first upper body 120 and the second upper body 130 to provide a flow path for air. The space 109 may be referred to as a "blowing space", a "valley", or a "channel". The first upper body 120 may be referred to as a "first tower", and the second upper body 130 may be referred to as a "second tower".

The first upper body 120 may be spaced to the left from the second upper body 130. The first upper body 120 may be elongated lengthwise in the vertical direction. A first boundary surface 121 of the first upper body 120 toward the space 109 may define a portion of a boundary of the space 109. The first boundary surface 121 of the first upper body 120 may be a curved surface convex to the right or in a direction from the first upper body 120 toward the space 109. A first outer surface 122 of the first upper body 120 may be opposite the first boundary surface 121 of the first upper body 120. The first outer surface 122 of the first upper body 120 may be a curved surface convex to the left or in a direction opposite to a direction from the first upper body 120 toward the space 109.

For example, the first boundary surface 121 of the first upper body 120 may be elongated lengthwise in the vertical direction. For example, the first outer surface 122 of the first upper body 120 may be inclined and extended at a predetermined angle (acute angle) to the right or in a direction toward the space 109 with respect to a vertical line extending in the vertical direction.

A curvature of the first outer surface 122 of the first upper body 120 may be greater than a curvature of the first boundary surface 121 of the first upper body 120. In addition, the first boundary surface 121 of the first upper body 120 may meet the first outer surface 122 of the first upper body 120 to form an edge. The edge may be provided as a front end 120*f* and a rear end 120*r* of the first upper body 120. For example, the front end 120*f* may be inclined and extend at a predetermined angle (acute angle) backward with respect to a vertical line that extends in the vertical direction. For example, the rear end 120*r* may be inclined and extend at a predetermined angle (acute angle) forward with respect to a vertical line that extends in the vertical direction.

The second upper body 130 may be spaced to the right from the first upper body 120. The second upper body 130 may be elongated in the vertical direction. A second boundary surface 131 of the second upper body 130 toward the space 109 may define a portion of the boundary of the space 109. The second boundary surface 131 of the second upper body 130 may be a curved surface convex to the left or in a direction from the second upper body 130 toward the space 109. The second outer surface 132 of the second upper body 130 may be opposite the second boundary surface 131 of the second upper body 130. The second outer surface 132 of the second upper body 130 may be a curved surface convex to the right or in a direction opposite to a direction from the second upper body 130 toward the space 109.

For example, the second boundary surface 131 of the second upper body 130 may be elongated lengthwise in the vertical direction. For example, the second outer surface 132 of the second upper body 130 may be inclined and extend at a predetermined angle (acute angle) to the left or in a direction toward the space 109 with respect to a vertical line that extends in the vertical direction.

A curvature of the second outer surface 132 of the second upper body 130 may be greater than a curvature of the second boundary surface 131 of the second upper body 130. The second boundary surface 131 of the second upper body 130 may meet the second outer surface 132 of the second upper body 130 to form an edge. The edge may be provided as a front end 130*f* and a rear end 130*r* of the second upper body 130. For example, the front end 130*f* may be inclined and extend at a predetermined angle (acute angle) backward with respect to a vertical line that extends in the vertical direction. For example, the rear end 130*r* may be inclined and extend at a predetermined angle (acute angle) forward with respect to a vertical line that extends in the vertical direction.

The first upper body 120 and the second upper body 130 may be symmetrical in the lateral direction with the space 109 interposed therebetween. The first outer surface 122 of the first upper body 120 and the second outer surface 132 of the second upper body 130 may be positioned on a virtual curved surface that extends along an outer peripheral surface 111 of the lower body 110. In other words, the first outer surface 122 of the first upper body 120 and the second outer surface 132 of the second upper body 130 may be smoothly connected to the outer peripheral surface 111 of the lower body 110. An upper surface of the first upper body 120 and an upper surface of the second upper body 130 may be provided as horizontal surfaces. In this case, the blower 1 may be formed in a truncated cone shape as a whole, for example. As a result, a risk of the blower 100 being overturned by an external impact may be lowered.

A groove 141 may be positioned between the first upper body 120 and the second upper body 130 and may be elongated lengthwise in a frontward-rearward direction. The groove 141 may be a curved surface concave downward. The groove 141 may include a first side 141*a* (see FIG. 5) connected to a lower side of the first boundary surface 121 of the first upper body 120 and a second side 141*b* (see FIG. 5) connected to a lower side of the second boundary surface 131 of the second upper body 130. The groove 141 may form a portion of a boundary of the space 109. Air flowing inside of the lower body 110 due to the fan 50 described hereinafter may be distributed to the inner space of the first upper body 120 and the inner space of the second upper body 130 with the groove 141 interposed therebetween. The groove 141 may be referred to as a "connection groove" or a "connection surface".

A cover 113 may be detachably coupled to the lower body 110. The cover 113 may be provided as a portion of the lower body 110. When the cover 113 is separated from the lower body 110, a user may access the inner space of the lower body 110. For example, the suction hole 112 may also be formed at the cover 113.

A display (not shown) may be provided at a front of the lower body 110 and may include an interface that displays drive information of the blower 100 or receives a user's command. For example, the display may include a touch panel.

Figure 2:
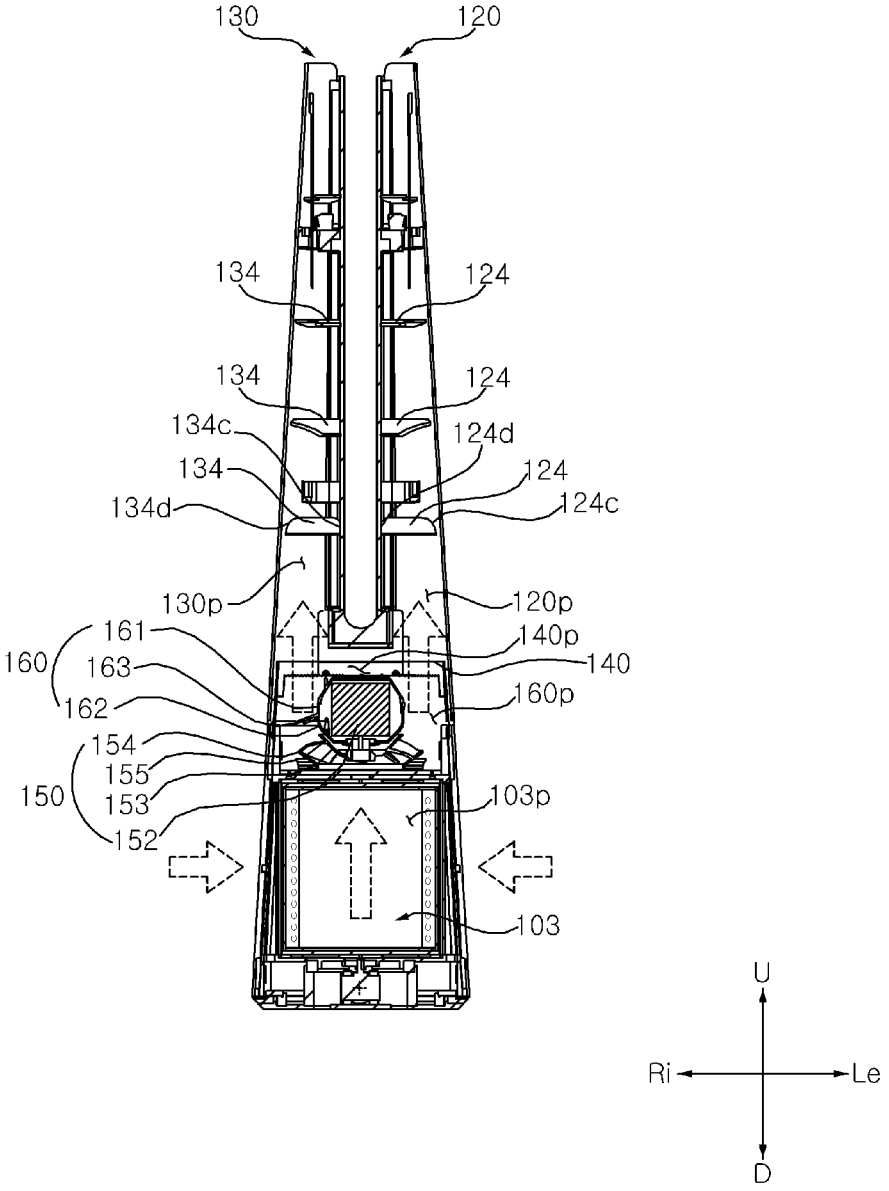
FIG. 2 is a cross-sectional view, taken along line II-II' of FIG. 1.

Referring to FIG. 2, the lower body 110 may provide an inner space in which a filter 103, a fan 150, and an air guide 160 may be installed, described hereinafter.

The filter 103 may be detachably installed in the inner space of the lower body 110. The filter 103 may be formed in a cylindrical shape as a whole, for example. That is, the filter 103 may include a hole 103*p* formed to pass through the filter 103 in the vertical direction. In this case, indoor air may flow into the lower body 110 through the suction hole 112 (see FIG. 1) by operation of the fan 150 described hereinafter. Indoor air flowing into the lower body 110 may be purified by flowing from an outer circumferential surface of the filter 103 to an inner circumferential surface of the filter 103 and may flow upward through the hole 103*p*.

The fan 150 may be installed in the inner space of the lower body 110 and may be disposed above the filter 103. The fan 150 may cause a flow of air to flow into the blower 100 or be discharged from the blower 100 to an outside. The fan 150 may include a fan housing 151 (see FIG. 20), a fan motor 152, a hub 153, a shroud 154, and a blade 155. The fan 150 may be referred to as a "fan assembly" or a "fan module".

The fan housing 151 may form an exterior of the fan 150. The fan housing 151 may include a suction port (no reference numeral) formed to pass through the fan housing 151 in the vertical direction. The suction port may be formed at a lower end of the fan housing 151 and may be referred to as a "bell mouth".

The fan motor 152 may provide a rotational force. The fan motor 152 may be a centrifugal fan motor or a four-flow fan motor, for example. The fan motor 152 may be supported by a motor cover 162 described hereinafter. A rotational shaft of the fan motor 152 may extend to a lower side of the fan motor 152 and may penetrate a lower surface of the motor cover 162. The hub 153 may be coupled with the rotational shaft and may rotate together with the rotational shaft. The shroud 154 may be spaced apart from the hub 153. A plurality of blades 155 may be disposed between the shroud 154 and the hub 153.

Accordingly, when the fan motor 152 is driven, air may flow into the fan 150 in an axial direction of the fan motor 152, that is, a longitudinal direction of the rotational shaft, through the suction port and may be discharged in a radial direction of the fan motor 152 at an upper side.

The air guide 160 may provide a flow path 160*p* through which air discharged from the fan 150 may flow. For example, the flow path 160*p* may be an annular flow path. The air guide 160 may include a guide body 161, a motor cover 162, and a guide vane 163. The air guide 160 may be referred to as a "diffuser".

The guide body 161 may form an exterior of the air guide 160. The motor cover 162 may be disposed at a center portion of the air guide 160. For example, the guide body 161 may be formed in a cylindrical shape. The motor cover 162 may be formed in a bowl shape. In this case, the above-described annular flow path 160*p* may be formed between the guide body 161 and the motor cover 162. The guide vane 163 may guide air provided to the flow path 160*p* from the fan 150 upward. A plurality of guide vanes 163 may be disposed at the annular flow path 160*p* and may be spaced apart from each other in a circumferential direction of the guide body 161. Each of the plurality of guide vanes 163 may extend from an outer surface of the motor cover 162 to an inner circumferential surface of the guide body 161.

A distribution unit (distributor) 140 may be positioned above the air guide 160 and may be disposed between the lower body 110 and the upper bodies 120 and 130. The distribution unit 140 may provide a flow path 140*p* through which air passing through the air guide 160 may flow. Air passing through the air guide 160 may be distributed to the first upper body 120 and the second upper body 130 through the distribution unit 140. In other words, the air guide 160 may guide air flowing due to the fan 150 to the distribution unit 140, and the distribution unit 140 may guide air from the air guide 160 to the first upper body 120 and the second upper body 130. The groove 141 (see to FIG. 1) may form a portion of an outer surface of the distribution unit 140. The distribution unit 140 may be referred to as a "middle body", an "inner body", or a "tower base".

For example, the first upper body 120 and the second upper body 130 may be laterally symmetrical. The first upper body 120 may provide a first flow path 120*p* through which a portion of air passing through the air guide 160 may flow. The first flow path 120*p* may be formed in the inner space of the first upper body 120. The second upper body 130 may provide a second flow path 130*p* through which the rest of the air passing through the air guide 160 may flow. The second flow path 130*p* may be formed in the inner space of the second upper body 130. The first flow path 120*p* and the second flow path 130*p* may be communicate with the flow path 140*p* of the distribution unit 140 and the flow path 160*p* of the air guide 160.

Figure 3:
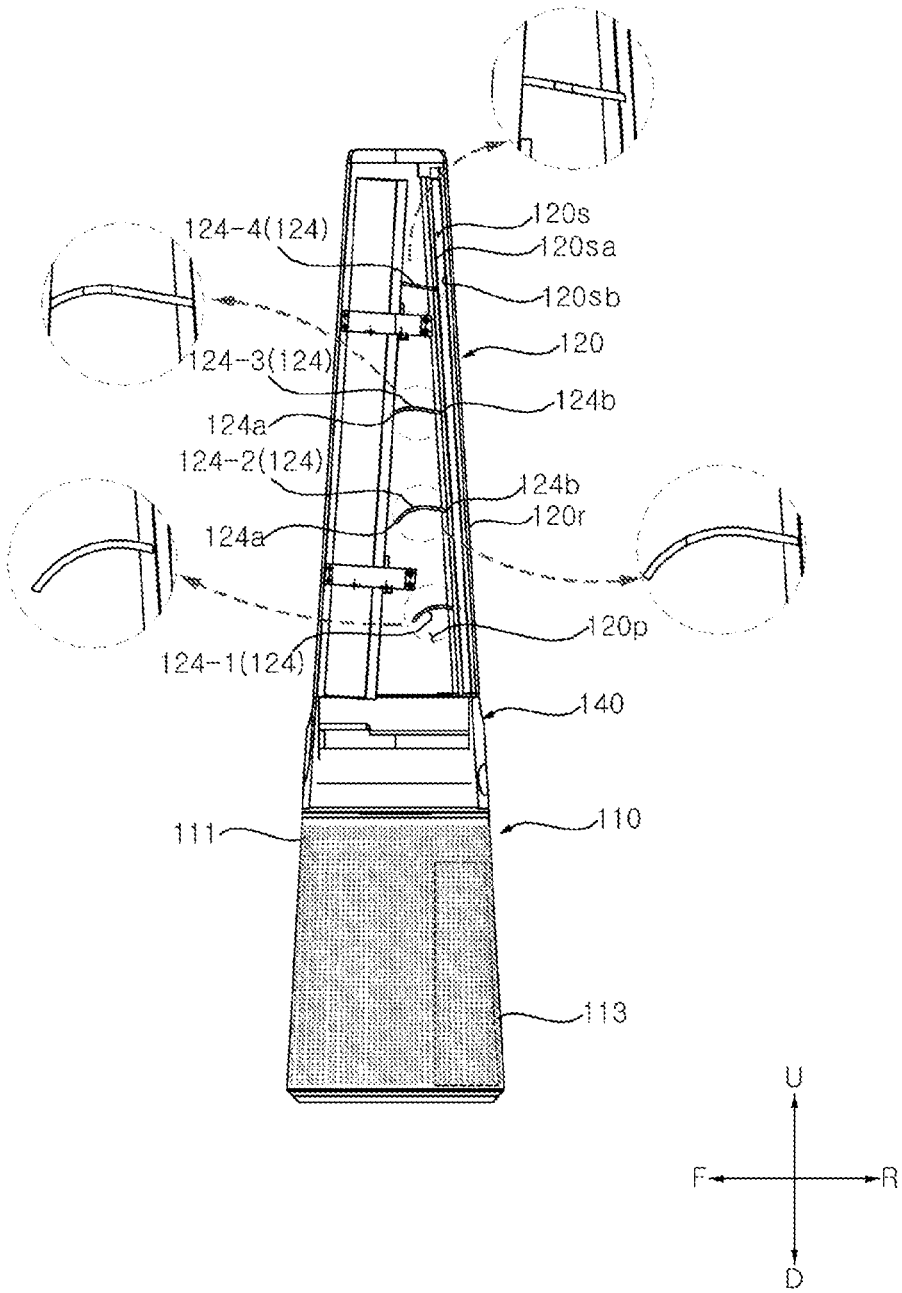
FIG. 3 is a left side view of FIG. 8 described hereinafter.

Referring to FIGS. 1 and 3, a first slit 120*s* may discharge air flowing through the first flow path 120*p* to the space 109. The first slit 120*s* may be adjacent to a rear end 120*r* of the first upper body 120 and may be formed to pass through the first boundary surface 121 of the first upper body 120. The first slit 120*s* may be formed along the rear end 120*r* of the first upper body 120. For example, the first slit 120*s* may be hidden from a user's gaze looking in a frontward direction to a rearward direction of the blower 100.

The first slit 120*s* may be inclined at a predetermined angle (acute angle) forward with respect to a vertical line that extends in the vertical direction. For example, the first slit 120*s* may be parallel to the rear end 120*r* of the first upper body 120. For another example, the first slit 120*s* may not be parallel to the rear end 120*r* of the first upper body 120, and a slope of the first slit 120*s* with respect to the vertical line may be greater than a slope of the rear end 120*r*.

Figure 4:
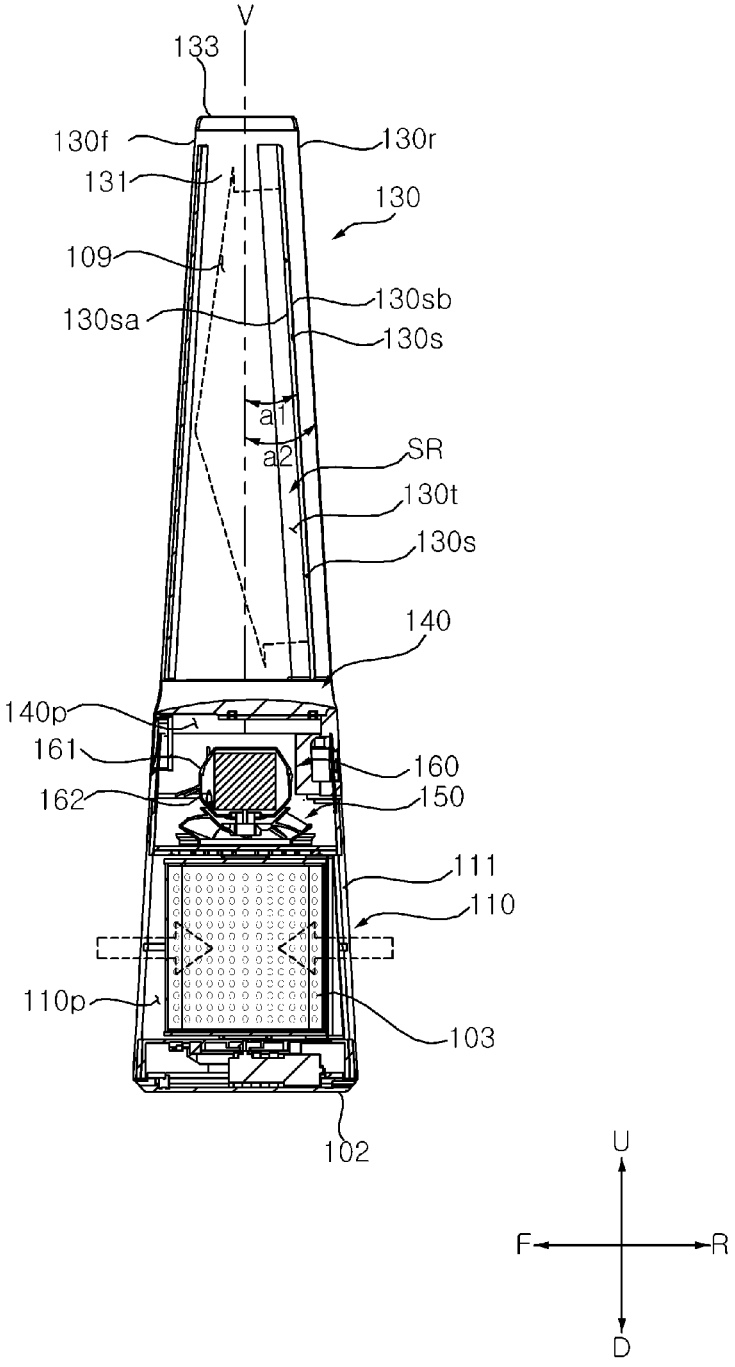
FIG. 4 is a cross-sectional view, taken along line IV-IV' of FIG. 1.

Referring to FIGS. 1 and 4, a second slit 130*s* may discharge air flowing through the second flow path 130*p* (see FIG. 2) to the space 109. The second slit 130*s* may be adjacent to the rear end 130*r* of the second upper body 130 and may be formed to pass through the second boundary surface 131 of the second upper body 130. The second slit 130*s* may be formed to extend along the rear end 130*r* of the second upper body 130. For example, the second slit 130*s* may be hidden from the user's gaze looking from the frontward direction to the rearward direction of the blower 100.

The second slit 130*s* may be formed to be inclined at a predetermined angle (acute angle) forward with respect to the vertical line that extends in the vertical direction. For example, the second slit 130*s* may be parallel to the rear end 130*r* of the second upper body 130. For another example, the second slit 130*s* may not be parallel to the rear end 130*r* of the second upper body 130. In this case, the second slit 130*s* may be inclined at a first angle a1, for example, 4 degrees, with respect to a vertical line V, and the rear end 130*r* may be inclined at a second angle a2, for example, 3 degrees, which is smaller than the first angle a1 with respect to the vertical line V. The first slit 120*s* (see FIG. 3) and the second slit 130*s* may face each other and may be symmetrical to each other.

Referring to FIGS. 2 and 3, vanes 124, 134 may be installed in the inner space of the first upper body 120 and the inner space of the second upper body 130 to guide a flow of air. First vane 124 may guide air rising from the first flow path 120*p* to the first slit 120*s*. The first vane 124 may be adjacent to the first slit 120*s* and may be fixed to the inner surface of the first upper body 120. The first vane 124 may have a convex shape upward. The first vane 124 may include a plurality of first vanes 124 spaced apart from each other in the vertical direction. Each of the plurality of first vanes 124 may have one (first) end adjacent to the first slit 120*s*, and the plurality of first vanes 124 may be spaced apart from each other along the first slit 120*s*. Each of the plurality of first vanes 124 may have different shapes.

For example, among the plurality of first vanes 124, a curvature of the vane positioned at a relatively lower side may be greater than a curvature of a vane positioned at relatively an upper side. Among the plurality of first vanes 124, a position of the other (second) end opposite to the one end of the vane positioned at relatively the lower side may be the same as or lower than the one end, and a position of the other end opposite to the one end of the vane positioned at relatively the upper side may be same as or higher than the one end. Accordingly, the first vane 124 may smoothly guide the air rising from the first flow path 120*p* to the first slit 120*s*.

Second vane 134 may guide air rising from the second flow path 130*p* to the second slit 120*s*. The second vane 134 may be adjacent to the second slit 130*s* and may be fixed to the inner surface of the second upper body 130. The second vane 134 may have a convex shape upward. The second vane 134 may include a plurality of second vanes 134 spaced apart from each other in the vertical direction. Each of the plurality of second vanes 134 may have one (first) end adjacent to the second slit 130*s*, and the plurality of second vanes 134 may be spaced apart from each other along the second slit 130*s*. Each of the plurality of second vanes 134 may have different shapes.

For example, among the plurality of second vanes 134, a curvature of a vane positioned at a relatively lower side may be greater than a curvature of a vane located at relatively an upper side. Among the plurality of second vanes 134, a position of the other (second) end opposite to the one end of the vane positioned at relatively the lower side may be the same as or lower than the one end, and a position of the other end opposite to the one end of the vane positioned at relatively the upper side may be same as or higher than the one end. Accordingly, the second vane 134 may smoothly guide the air rising from the second flow path 130*p* to the second slit 130*s*.

Figure 5:
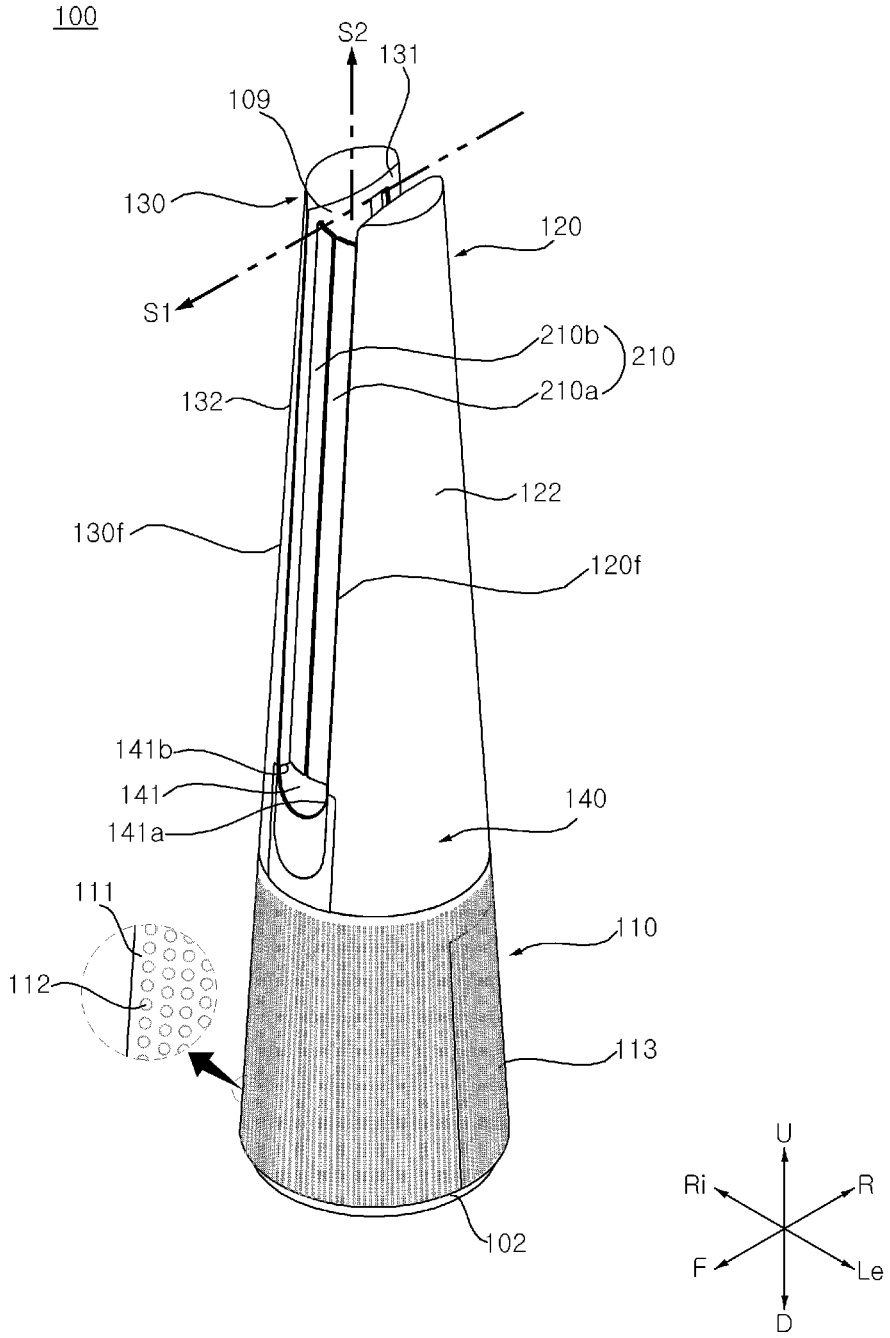
FIG. 5 is a perspective view showing a state in which a damper of a blower of FIG. 1 closes a front of a space.
Figure 6:
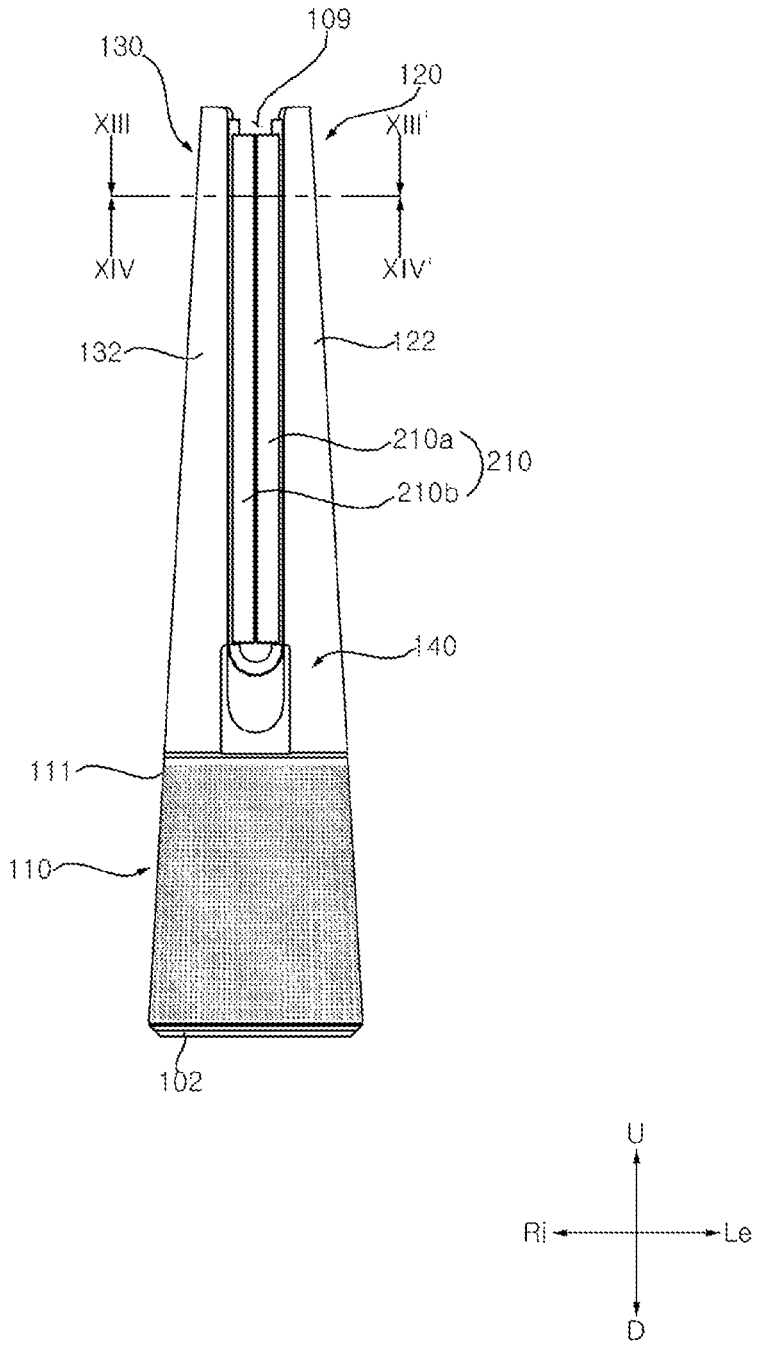
FIG. 6 is a front view of the blower of FIG. 5.

Referring to FIGS. 5 and 6, a damper 210 may be movably coupled to the first upper body 120 and/or the second upper body 130. The damper 210 may protrude from the first upper body 120 and/or the second upper body 130 toward the space 109. For example, the damper 210 may include first damper 210*a* and second damper 210*b*.

The first damper 210*a* may pass through a first slot 120*h* and protrude into the space 109, or may pass through the first slot 120*h* and be inserted into the first upper body 120. The first damper 210*a* may close the first slot 120*h* to prevent air flowing through the first flow path 120*p* from leaking to the outside through the first slot 120*h*. The first slot 120*h* may be adjacent to the front end 120*f* of the first upper body 120 and may be formed to pass through the first boundary surface 121 of the first upper body 120. The first slot 120*h* may extend along the front end 120*f* of the first upper body 120.

For example, the first slot 120*h* may be parallel to the front end 120*f*. For another example, the first slot 120*h* may not be parallel to the front end 120*f*, and a slope of the first slot 120*h* with respect to the vertical line may be greater than a slope of the front end 120*f*. The first slot 120*h* may be referred to as a "first board slit".

The second damper 210*b* may pass through a second slot 130*h* (see FIG. 7) and protrude into the space 109, or may pass through the second slot 130*h* and be inserted into the second upper body 130. The second damper 210*b* may close the second slot 130*h* to prevent air flowing through the second flow path 130*p* from leaking to the outside through the second slot 130*h*. The second slot 130*h* may be adjacent to the front end 130*f* of the second upper body 130 and may be formed to pass through the second boundary surface 131 of the second upper body 130. The second slot 130*h* may extend along the front end 130*f* of the second upper body 130.

For example, the second slot 130*h* may be parallel to the front end 130*f*. For another example, the second slot 130*h* may not be parallel to the front end 130*f*, and a slope of the second slot 130*h* with respect to the vertical line may be greater than a slope of the front end 130*f*. The second slot 130*h* may be referred to as a "second board slit".

The first slot 120*h* and the second slot 130*h* may face each other, and the first damper 210*a* and the second damper 210*b* may come into contact with each other or be spaced apart from each other. Accordingly, when the first damper 210*a* and the second damper 210*b* are located at the space 109, the first damper 210*a* and the second damper 210*b* may cover at least a portion of the front of the space 109 or close.

Figure 7:
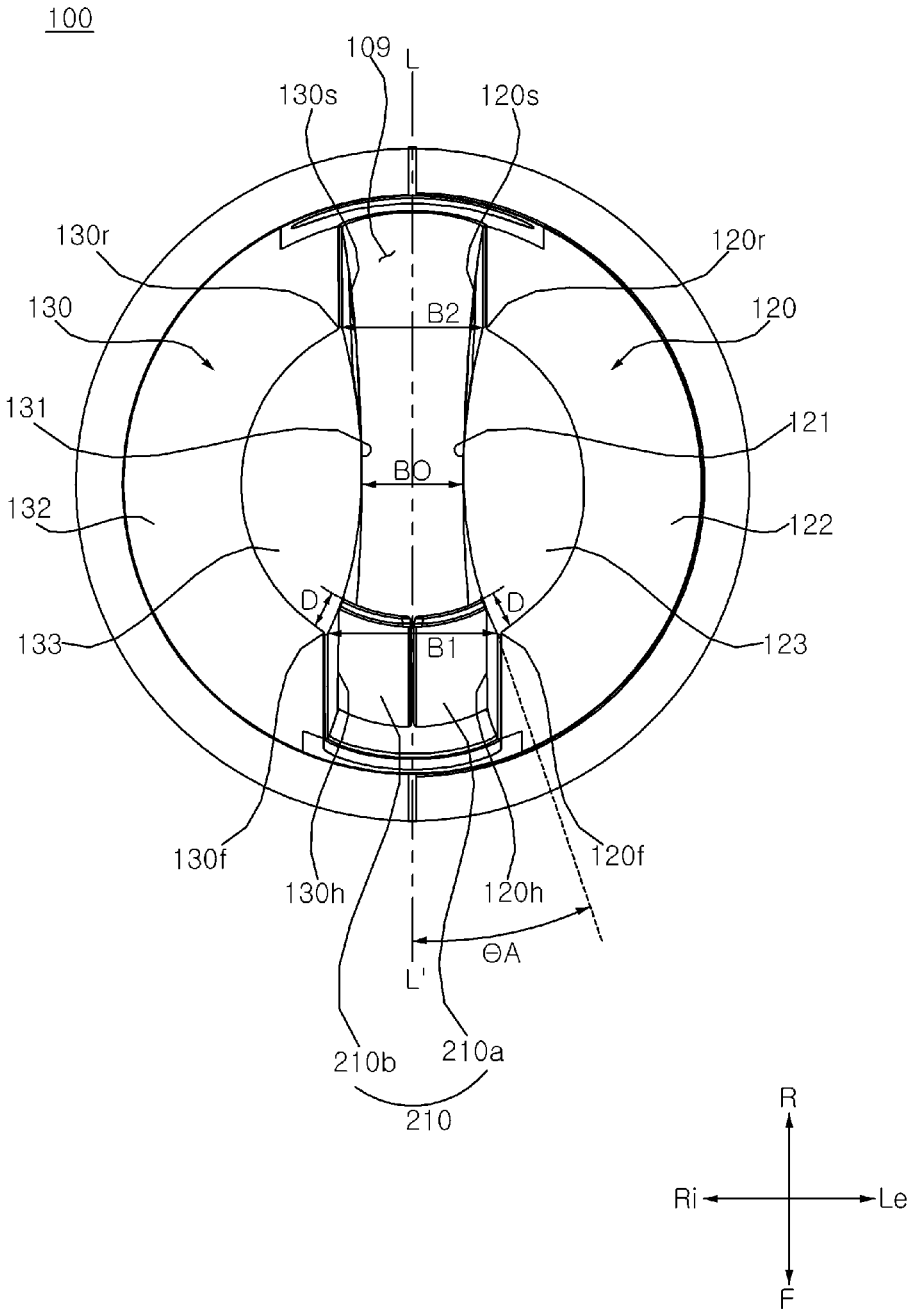
FIG. 7 is a plan view of the blower of FIG. 5.

Referring to FIG. 7, a distance D between the front end 120*f* and the first slot 120*h* of the first upper body 120 may be the same as a distance D between the front end 130*f* and the second slot 130*h* of the second upper body 130.

The first boundary surface 121 of the first upper body 120 and the second boundary surface 131 of the second upper body 130 may face each other and may form lateral boundaries of the space 109. The first boundary surface 121 of the first upper body 120 may be convex to the right, and the second boundary surface 131 of the second upper body 130 may be convex to the left. In other words, a gap between the first boundary surface 121 of the first upper body 120 and the second boundary surface 131 of the second upper body 130 may decrease from the rear to the front and then increase again. The gap may be a width of the space 109.

A first gap B1 may be defined as a gap between the front end 120*f* of the first upper body 120 and the front end 130*f* of the second upper body 130. A second gap B2 may be defined as a gap between the rear end 120*r* of the first upper body 120 and the rear end 120*r* of the second upper body 130. For example, the second gap B2 may be the same as or different from the first gap B1. A reference gap B0 may be a minimum of the gaps between the first boundary surface 121 of the first upper body 120 and the second boundary surface 131 of the second upper body 130. For example, the reference gap B0 may be 20 to 30 mm.

For one example, in the frontward-rearward direction, a gap between a center of the first boundary surface 121 of the first upper body 120 and a center of the second boundary surface 131 of the second upper body 130 may be the reference gap B0. For another example, in the frontward-rearward direction, a gap between a portion positioned in front of the center of the first boundary surface 121 of the first upper body 120 and a portion positioned in front of the center of the second boundary surface 131 of the second upper body 130 may be the reference gap B0. For the other example, in the frontward-rearward direction, a gap between a portion positioned behind the center of the first boundary surface 121 of the first upper body 120 and a portion positioned behind the center of the second boundary surface 131 of the second upper body 130 may be the reference gap B0.

In this case, a width of a rear portion of the space 109 may be the second gap B2, a width of a center portion of the space 109 may be the reference gap B0, and a width of the space 109 may decrease from the rear portion to the central part. A width of a front portion of the space 109 may be the first gap B1, and the width of the space 109 may increase from the center portion toward the front portion.

Figure 8:
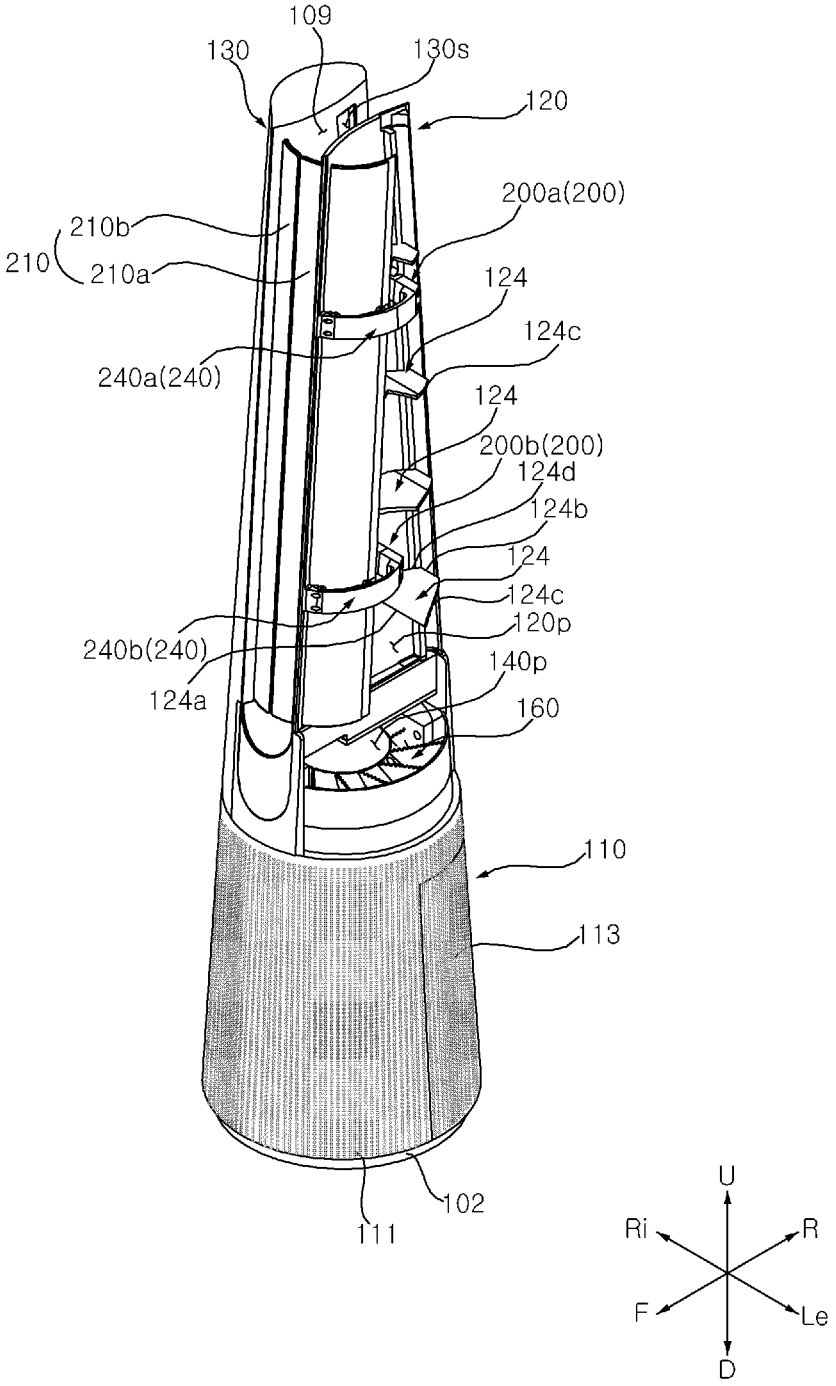
FIG. 8 is a perspective view showing a state in which a first outer surface of a first upper body of the blower of FIG. 5 is removed.
Figure 9:
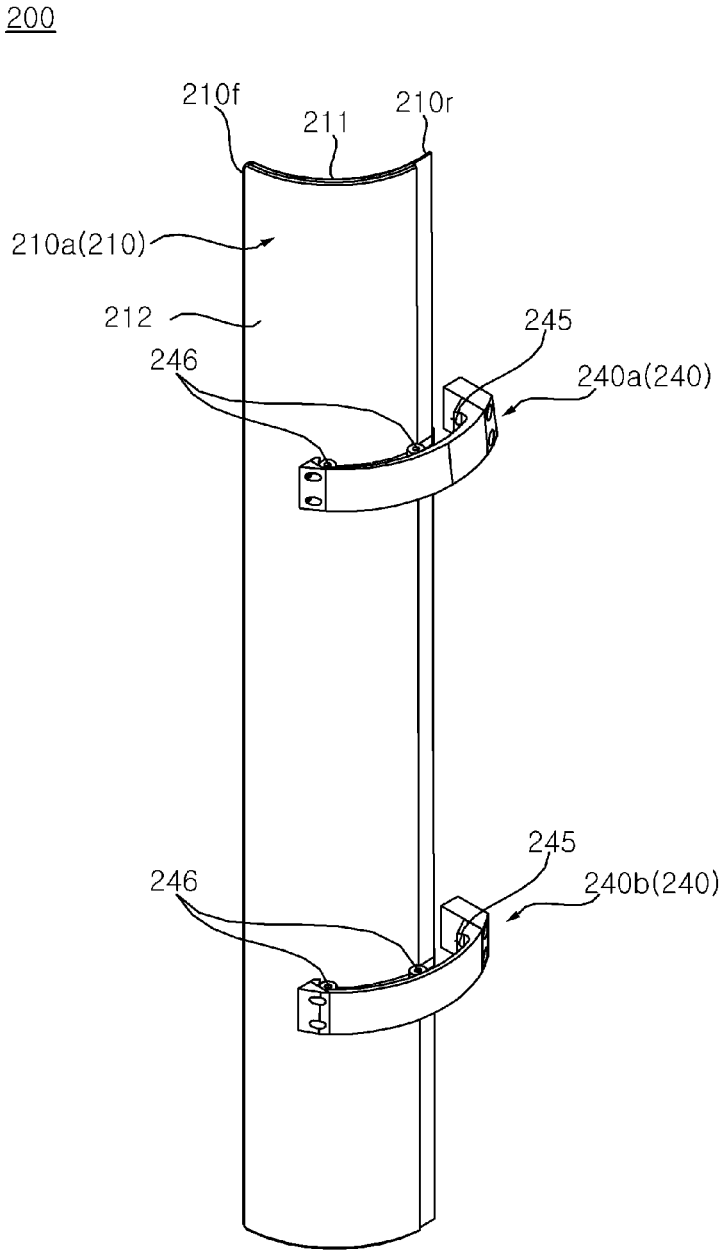
FIGS. 9 to 12 are views for explaining a damper assembly of the blower of FIG. 5.

Referring to FIGS. 8 and 9, a damper assembly 200 including the damper 210 may be installed on the upper bodies 120 and 130. The damper assembly 200 may include a first damper assembly 200*a* installed on the first upper body 120 and having first damper 210*a*, and may include a second damper assembly 200*b* (not shown) installed on the second upper body 130 and having second damper 210*b*. The first damper assembly 200*a* and the second damper assembly 200*b* may be symmetrical to each other in the lateral direction. The damper assembly 200 may be referred to as an "air flow converter".

The damper assembly 200 may include the above-described damper 210 and guide 240. The damper 210 may be flat or curved. For example, the damper 210 may be an outwardly convex plate. In this case, the damper 210 may extend while drawing an arc of a constant curvature with respect to a center positioned inside an inner surface 211. A front end 210*f* of the damper 210 may pass through the aforementioned slots 120*h* and 130*h*. The guide 240 may be coupled to an outer surface 212 of the damper 210 to guide movement of the damper 210. For example, the guide 240 may include a first guide 240*a* and a second guide 240*b* separated from each other in the vertical direction and having a same configuration.

The damper 210 may be referred to as a "board", and the guide 240 may be referred to as a "board guide".

Figure 10:
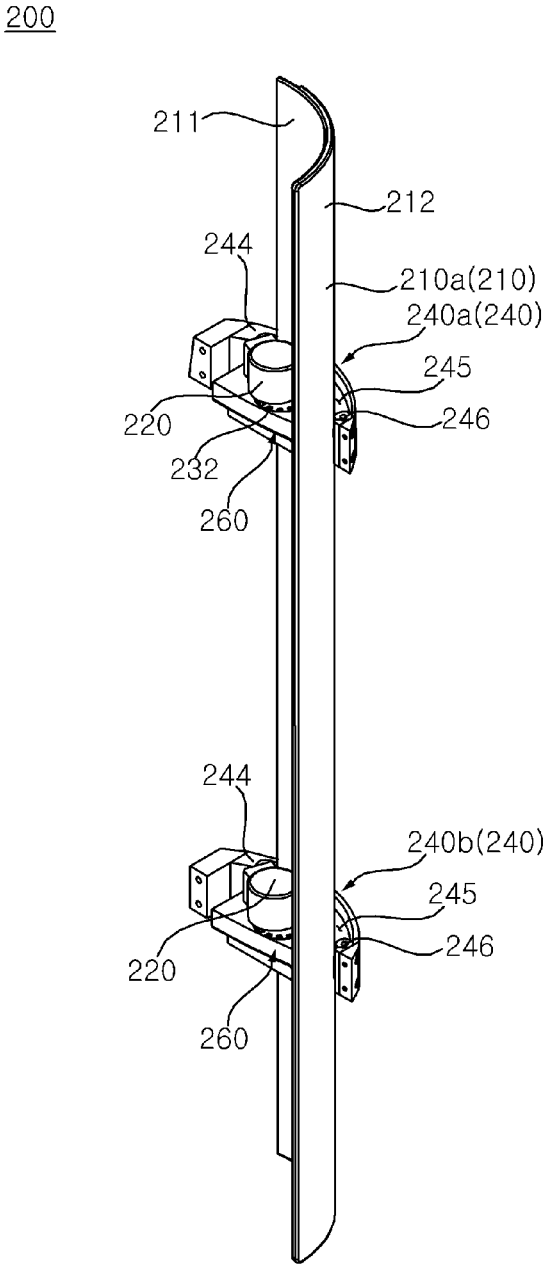
Figure 11:
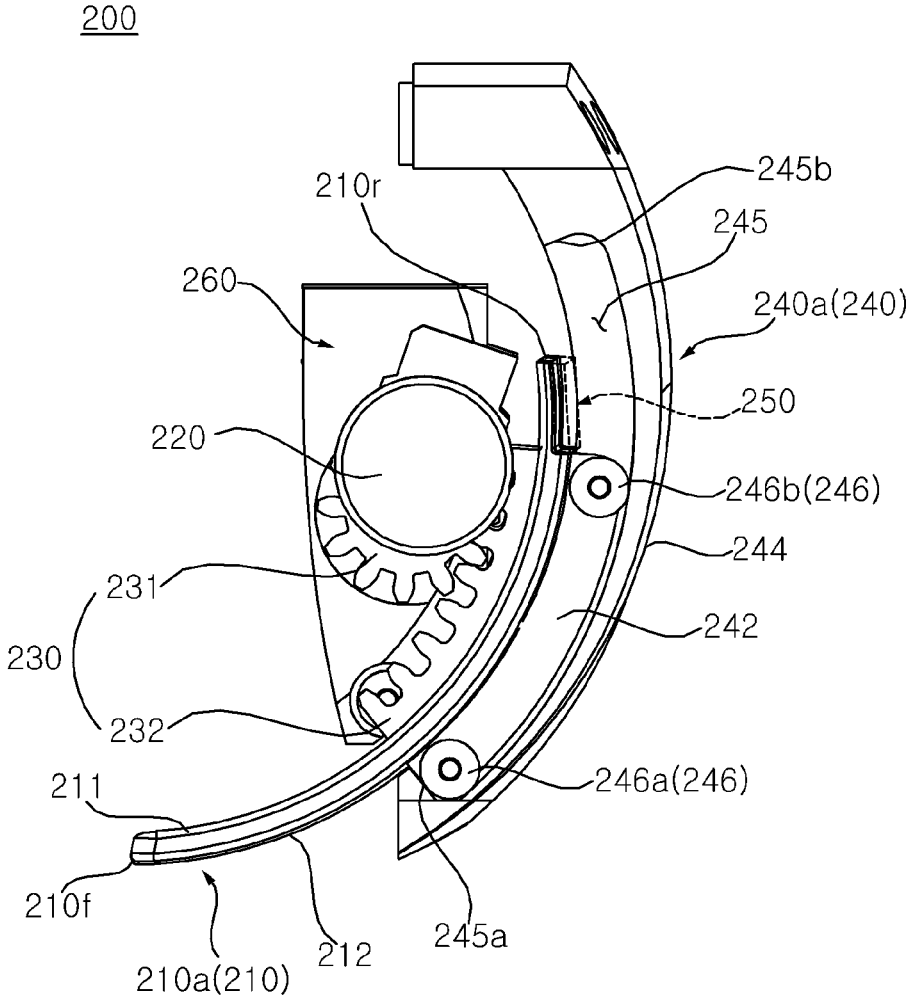
Figure 12:
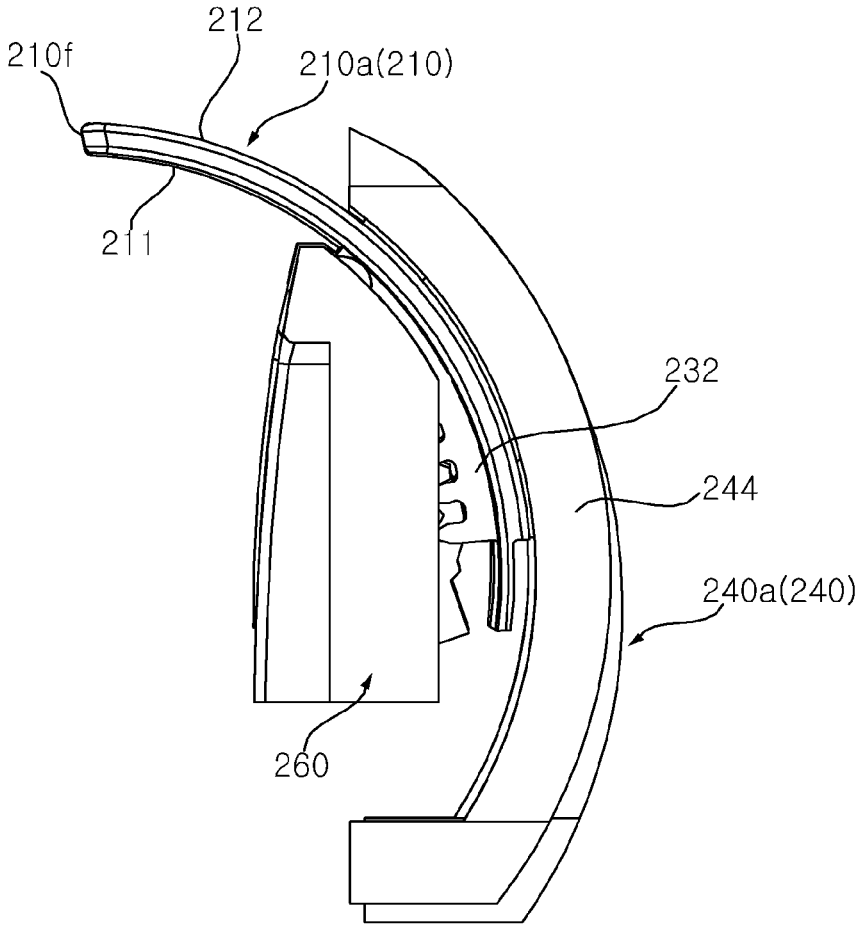

Referring to FIGS. 10 to 12, the damper assembly 200 may include a motor 220, a power transmission member 230, a light emitting member 250, and a motor mount 260, in addition to the damper 210 and the guide 240 described above. The motor 220, the power transmission member 230, the light emitting member 250, and the motor mount 260 may be connected or coupled to each of the first guide 240*a* and the second guide 240*b* described above.

The motor 220 may provide a rotational force. The motor 220 may be an electric motor capable of adjusting a rotational direction, a rotational speed, and a rotational angle. The motor 220 may be fixed or coupled to the motor mount 260. For example, the motor mount 260 may be fixed to the inner surfaces of the upper bodies 120 and 130 and coupled to a lower side of the motor 220 to support the motor 220.

The power transmission member 230 may include a pinion 231 and a rack 232. The pinion 231 may be fixed to a rotational shaft of the motor 220 and may rotate together with the rotational shaft. The rack 232 may engage the pinion 231. The rack 232 may be fixed or coupled to the inner surface 211 of the damper 210. For example, the rack 232 may have a shape corresponding to a shape of the damper 210. In other words, the rack 232 may extend by drawing an arc with a curvature equal to or greater than a curvature of the damper 210, and gear-teeth engaged with the pinion 231 may face the inner space of the upper bodies 120 and 130.

Accordingly, a drive force of the motor 220 may be transmitted to the damper 210 through the power transmission member 230, so that the damper 210 may move along a circumferential direction of the damper 210. The damper 210 may include a transparent material, and the light emitting member 250 may be coupled to the damper 210 to provide light. For example, the light emitting member 250 may be a light emitting diode (LED). In this case, whether or not the light emitting member 250 is operated or a light emission color may be adjusted in response to a movement of the damper 210.

The guide 240 may include a moving guide 242, a fixed guide 244, and a friction reducing member 246. The movement guide 242 may be coupled to the damper 210 and/or the rack 232 and may move together with the damper 210 and the rack 232. For example, the moving guide 242 may be fixed to the outer surface 212 of the damper 210 and may be extended while drawing an arc with a curvature equal to or less than the curvature of the damper 210. A length of the moving guide 242 may be smaller than a length of the damper 210.

The fixed guide 244 may be coupled to the moving guide 242 at an outside of the moving guide 242 to support the moving guide 242. In this case, the moving guide 242 may be disposed between the damper 210 and the fixed guide 244.

A guide groove 245 may be formed at an inner surface of the fixed guide 244, and the moving guide 242 may be movably inserted into the guide groove 245. For example, the guide groove 245 may be formed by drawing an arc with a curvature equal to the curvature of the moving guide 242, and a length of the guide groove 245 may be greater than the length of the moving guide 242. In this case, a first end 245*a* of the guide groove 245 may limit rotation or movement of the moving guide 242 in a first direction. The first direction may be a direction in which the damper 210 protrudes toward the space 109. In addition, a second end 245*b* of the guide groove 245 may limit rotation or movement of the moving guide 242 in a second direction. The second direction, as a direction opposite to the first direction, may be opposite to a direction in which the damper 210 protrudes toward the space 109.

The friction reducing member 246 may reduce friction due to movement of the moving guide 242 with respect to the fixed guide 244. For example, the friction reducing member 246 may be a roller that is rotatably provided with respect to a central axis parallel to the vertical direction. The friction reducing member 246 may be coupled to the moving guide 242, and at least a portion of the friction reducing member 246 may protrude in a radial direction of the moving guide 242 to be movably coupled to the fixed guide 244. For example, the friction reducing member 246 may have elastic force and may be supported by the fixed guide 244. For example, the friction reducing member 246 may include a first friction reducing member 246*a* coupled to a first side of the moving guide 242 and a second friction reducing member 246*b* coupled to a second side. Accordingly, the guide 240 may minimize friction or operational noise caused by movement of the damper 210 and the moving guide 242 while guiding rotation or movement of the damper 210 and the moving guide 242.

Figure 13:
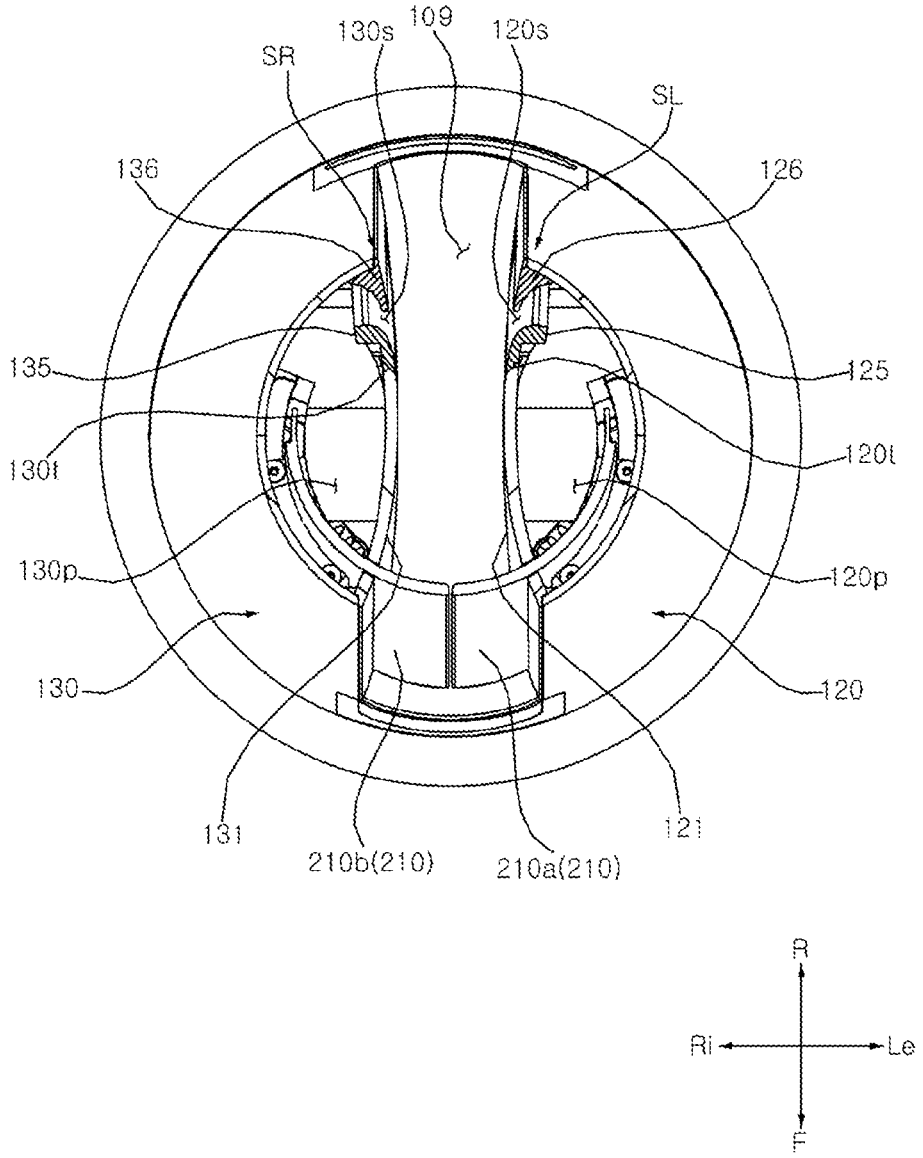
FIG. 13 is a cross-sectional view, taken along line XIII-XIII' of FIG. 6.
Figure 14:
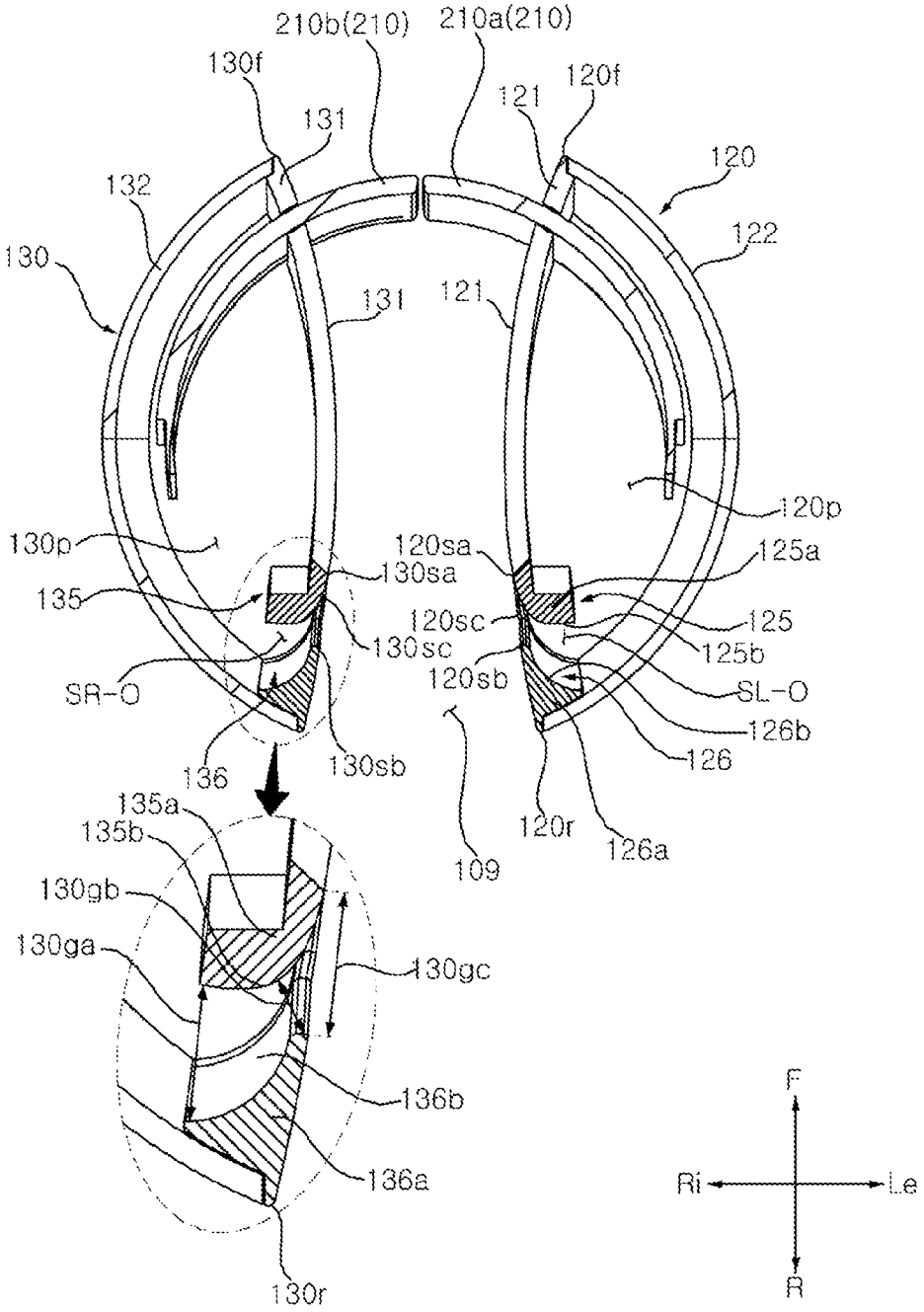
FIG. 14 is a cross-sectional view, taken along line XIV-XIV' of FIG. 6.

Referring to FIGS. 13 and 14, a first discharge body SL may be provided at a rear portion of the first upper body 120 and may provide a first opening SL-0. A second discharge body SR may be provided at a rear portion of the second upper body 130 and may provide a second opening SR-0. The first opening SL-0 and the second opening SR-0 may face each other. For example, the first opening SL-0 may be formed by inclining or bending toward a front of the second opening SR-0. For example, the second opening SR-0 may be formed by inclining or bending toward a front of the first opening SL-0.

The first discharge body SL may include a first portion 125 and a second portion 126. The first portion 125 and the second portion 126 may be spaced apart from each other, and the first opening SL-0 may be formed between the first portion 125 and the second portion 126. The space 109 may communicate with the first flow path 120*p* through the first opening SL-0. An outlet end of the first opening SL-0 may be provided as the first slit 120*s*. An inlet end of the first opening SL-0 may be located at the first flow path 120*p*.

In this case, a first border 120*sa* may form a front boundary of the first slit 120*s*, a second border 120*sb* may form a rear boundary of the first slit 120*s*, a third border 120*sc* may form an upper boundary of the first slit 120*s*, and a fourth border 120*sd* may form a lower boundary of the first slit 120*s*. The first opening SL-0 may be referred to as a "first channel".

The first portion 125 may be provided at a portion that forms the first boundary surface 121 of the first upper body 120. The first portion 125 may be bent and extend from the first boundary surface 121 toward the first flow path 120*p*. In this case, a cross section 125*a* of the first portion 125 may have a shape bent by approximately 90 degrees from the first boundary surface 121.

The second portion 126 may be provided at a portion that forms the first boundary surface 121 of the first upper body 120. The second portion 126 may be positioned behind the first portion 125. The second portion 126 may form the rear end 120*r* of the first upper body 120. The second portion 126 may form a portion of the first boundary surface 121. The second portion 126 may protrude from the first boundary surface 121 toward the first flow path 120*p*. A thickness of the second portion 126 may increase toward a rear. In this case, a cross-section 126*a* of the second portion 126 may approximatively have a wedge shape, and a portion of the second portion 126 may be coupled to a portion that form the first outer surface 122 of the first upper body 120.

The first opening SL-0 may be formed between an outer surface 125*b* of the first portion 125 and an inner surface 126*b* of the second portion 126. The outer surface 125*b* of the first portion 125 may have a first curvature greater than a curvature of the first boundary surface 121. The inner surface 126*b* of the second portion 126 may have a second curvature greater than a curvature of the first boundary surface 121. The first curvature may be greater than the second curvature. A center of the curvature of the outer surface 125*b* and a center of the curvature of the inner surface 126*b* may be positioned at the first flow path 120*p*. The center of the curvature of the outer surface 125*b* may be positioned in front of a right side of the center of the curvature of the inner surface 126*b*. The outer surface 125*b* of the first portion 125 may be referred to as a "first discharge surface", and the inner surface 126*b* of the second portion 126 may be referred to as a "second discharge surface".

A first gap 120*ga* may be defined as a gap between a first side of the inner surface 126*b* and a first side of the outer surface 125*b*. A second gap 120*gb* may be defined as a gap between a second side of the inner surface 126*b* and the outer surface 125*b* closest to the second side of the inner surface 126*b*. A third gap 120*gc* may be defined as a gap between the second side of the inner surface 126*b* and the second side of the outer surface 125*b*. The second side of the inner surface 126*b* may be provided as a second border 120*sb* forming a rear boundary of the first slit 120*s*, and the second side of the outer surface 125*b* may be provided as a first border 120*sa* forming a front boundary of the first slit 120*s*.

In this case, the first gap 120*ga* may mean a gap of an inlet end of the first opening SL-0, the second gap 120*gb* may mean a minimum gap between the inlet end and an outlet end of the first opening SL-0, and the third gap 120*gc* may mean a gap of the outlet end of the first opening SL-0. The third gap 120*gc* may mean a width or gap of the first slit 120*s*. In addition, the second gap 120*gb* may be smaller than the first gap 120*ga*, and the third gap 120*gc* may be larger than the second gap 120*gb*.

Accordingly, the width or gap of the first opening SL-0 may decrease from an inlet to an outlet of the first opening SL-0 and then increase again. A section in which the width or gap of the first opening SL-0 is reduced may be referred to as a "tapered section" or a "converging section".

Air accelerated while passing through the tapered section may be smoothly guided to the first boundary surface 121 along the outer surface 125*b* of the first portion 125. That is, a flow direction of the air discharged from the first flow path 120*p* to the space 109 may be smoothly switched from a rearward direction to a frontward direction through the first opening SL-0.

The second discharge body SR may include a first portion 135 and a second portion 136. The first portion 135 and the second portion 136 may be spaced apart from each other, and the second opening SR-0 may be formed between the first portion 135 and the second portion 136. The space 109 may communicate with the second flow path 130*p* through the second opening SR-0. An outlet end of the second opening SR-0 may be provided as the second slit 130*s*. An inlet end of the second opening SR-0 may be positioned at the second flow path 130*p*.

In this case, a first border 130*sa* may form a front boundary of the second slit 130*s*, a second border 130*sb* may form a rear boundary of the second slit 130*s*, a third border 130*sc* may form an upper boundary of the second slit 130*s*, and a fourth border 130*sd* may form a lower boundary of the second slit 130*s*. The second opening SR-0 may be referred to as a "second channel".

The first portion 135 may be provided at a portion that forms the second boundary surface 131 of the second upper body 130. The first portion 135 may be bent and extend from the second boundary surface 131 toward the second flow path 130*p*. In this case, a cross section 135*a* of the first portion 135 may have a shape bent by approximately 90 degrees from the second boundary surface 131.

The second portion 136 may be provided at a portion that forms the second boundary surface 131 of the second upper body 130. The second portion 136 may be positioned behind the first portion 135. The second portion 136 may form the rear end 130*r* of the second upper body 130. The second portion 136 may form a portion of the second boundary surface 131. The second portion 136 may protrude from the second boundary surface 131 toward the second flow path 130*p*. A thickness of the second portion 136 may increase toward the rear. In this case, a cross-section 136*a* of the second portion 136 may approximatively have a wedge shape, and a portion of the second portion 136 may be coupled to a portion that form the second outer surface 132 of the second upper body 130.

The second opening SR-0 may be formed between an outer surface 135*b* of the first portion 135 and an inner surface 136*b* of the second portion 136. The outer surface

135*b* of the first portion 135 may have a first curvature greater than a curvature of the second boundary surface 131. An inner surface 136*b* of the second portion 136 may have a second curvature greater than a curvature of the second boundary surface 131. The first curvature may be greater than the second curvature. A center of the curvature of the outer surface 135*b* and a center of the curvature of the inner surface 136*b* may be positioned at the second flow path 130*p*. The center of the curvature of the outer surface 135*b* may be positioned in front of a left side of the center of the curvature of the inner surface 136*b*. The outer surface 135*b* of the first portion 135 may be referred to as a "first discharge surface", and the inner surface 136*b* of the second portion 136 may be referred to as a "second discharge surface".

A first gap 130*ga* may be defined as a gap between a first side of the inner surface 136*b* and a first side of the outer surface 135*b*. A second gap 130*gb* may be defined as a gap between a second side of the inner surface 136*b* and the outer surface 135*b* closest to the second side of the inner surface 136*b*. A third gap 130*gc* may be defined as a gap between the second side of the inner surface 136*b* and a second side of the outer surface 135*b*. The second side of the inner surface 136*b* may be provided as a second border 130*sb* forming a rear boundary of the second slit 130*s*, and the second side of the outer surface 135*b* may be provided as a first border 130*sa* forming a front boundary of the second slit 130*s*.

In this case, the first gap 130*ga* may mean a gap of an inlet end of the second opening SR-0, the second gap 130*gb* may mean a minimum gap between the inlet end and an outlet end of the second opening SR-0, and the third gap 130*gc* may mean a gap of the outlet end of the second opening SR-0. The third gap 120*gc* may mean a width or gap of the first slit 120*s*. In addition, the second gap 130*gb* may be smaller than the first gap 130*ga*, and the third gap 130*gc* may be larger than the second gap 130*gb*.

Accordingly, the width or gap of the second opening SR-0 may decrease from an inlet to an outlet of the second opening SR-0 and then increase again. A section in which the width or gap of the second opening SR-0 is reduced may be referred to as a "tapered section" or a "converging section".

Air accelerated while passing through the tapered section may be smoothly guided to the second boundary surface 131 along the outer surface 135*b* of the first portion 135. That is, a flow direction of the air discharged from the second flow path 130*p* to the space 109 may be smoothly switched from a rearward direction to a frontward direction through the second opening SR-0.

Accordingly, a portion of the air flowing by the fan 150 (see FIG. 4) may be discharged to the space 109 through the first slit 120*s*, the rest of the air may be discharged to the space 109 through the second slit 130*s*, and so air may be mixed in the space 109. Due to the coanda effect, the air discharged to the space 109 may flow forward along the first boundary surface 121 of the first upper body 120 and the second boundary surface 131 of the second upper body 130.

Figure 15:
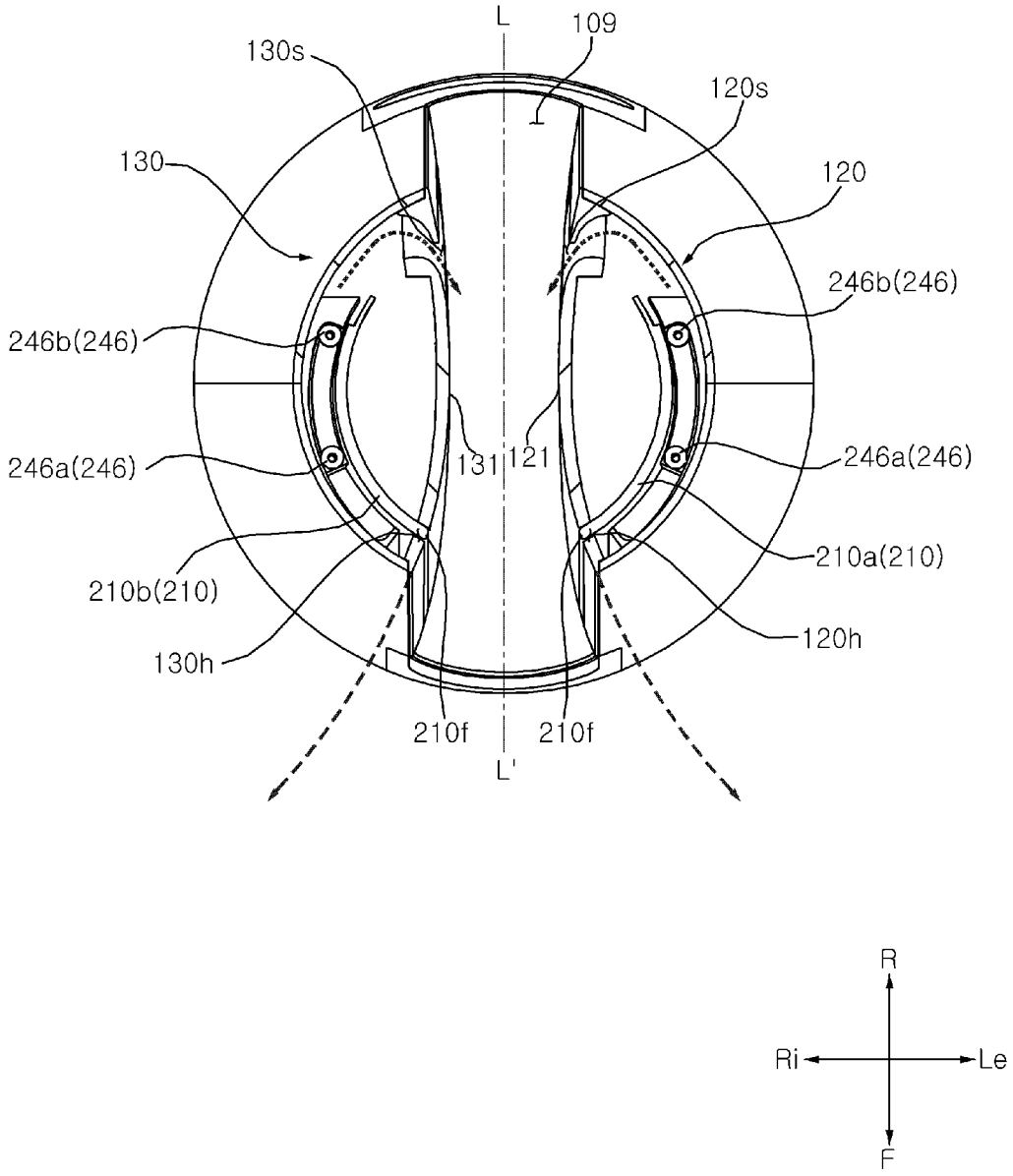
FIGS. 15 and 16 are views for explaining a diffused wind formed in a first state of a blower, with FIG. 15 being a top view of the blower, and FIG. 16 a perspective view of the blower, in which diffused airflow is represented by a dotted arrow.
Figure 16:
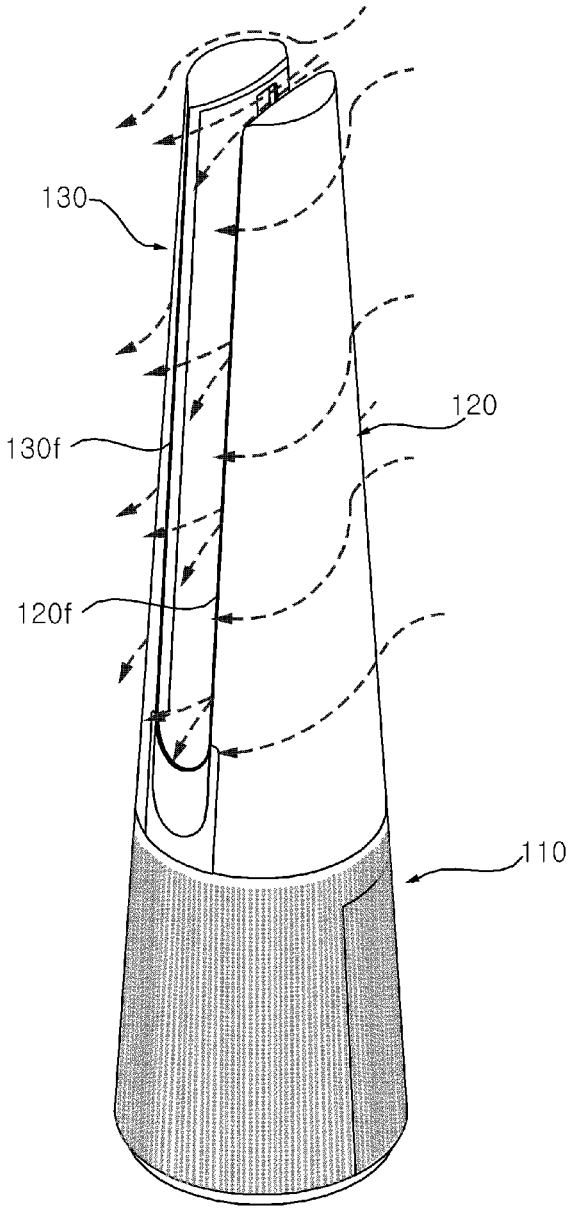

Referring to FIGS. 15 and 16, in a first state of the blower 100, a front end 210*f* of the damper 210 may be inserted or hidden in the slots 120*h* and 130*h*. In this case, the front end 210*f* of the damper 210 may form a continuous surface on the boundary surfaces 121, 131.

Accordingly, air discharged to the space 109 in response to operation of the fan 150 (see FIG. 4) may flow forward along the boundary surfaces 121, 131 of the upper bodies 120, 130. Air flowing forward may be dispersed the left and right along the curvature of the boundary surfaces 121, 131. Such a flow of air may form airflow in which air around the upper bodies 120, 130 entrained into the space 109 or flowing forward along the outer surfaces 122, 132. As a result, the blower 100 may provide airflow with rich volume to a user, for example.

Figure 17:
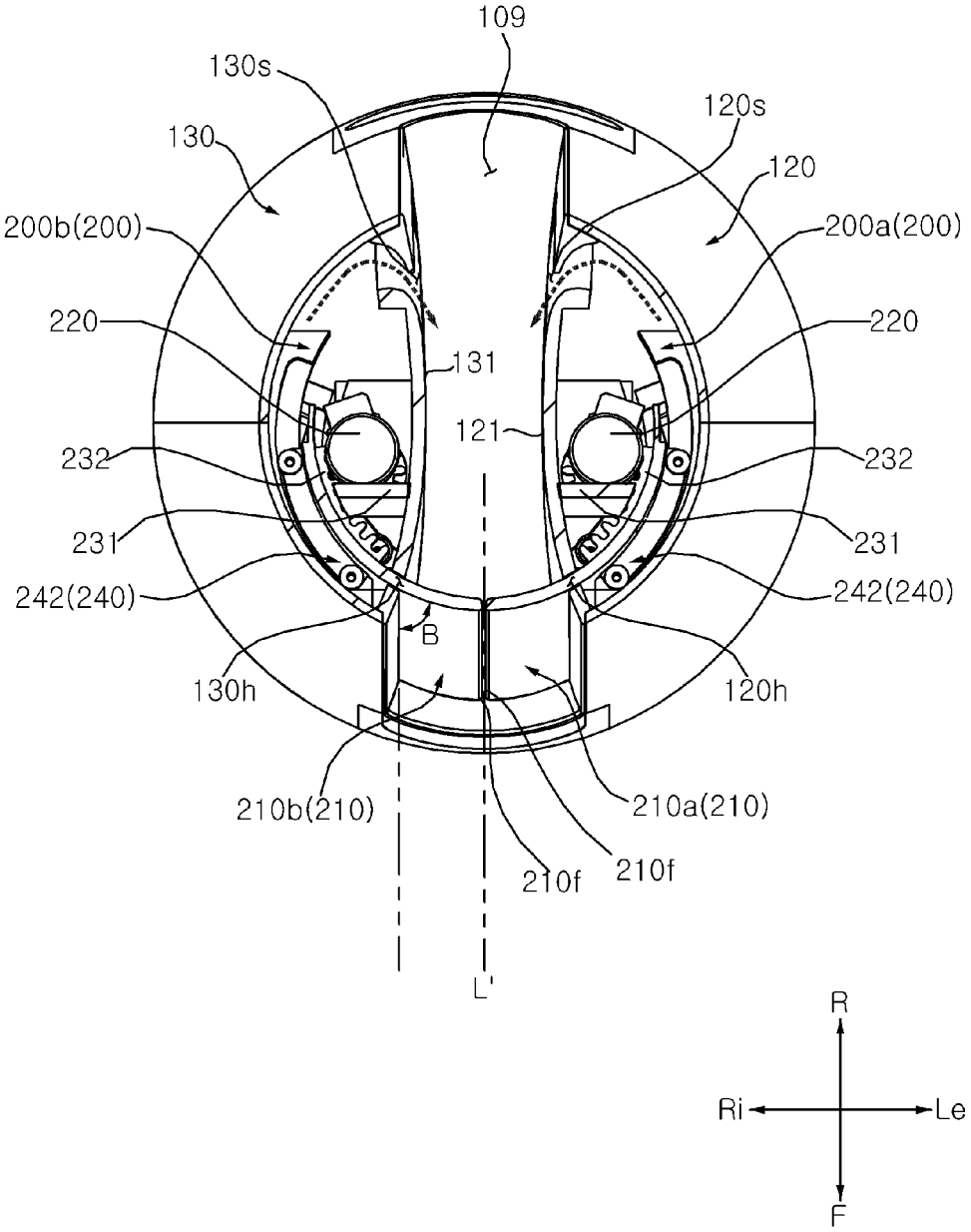
FIGS. 17 and 18 are views for explaining increased wind formed in a second state of a blower, with FIG. 17 being a top view of the blower, and FIG. 18 a perspective view of the blower, in which increased airflow is represented by a dotted arrow.
Figure 18:
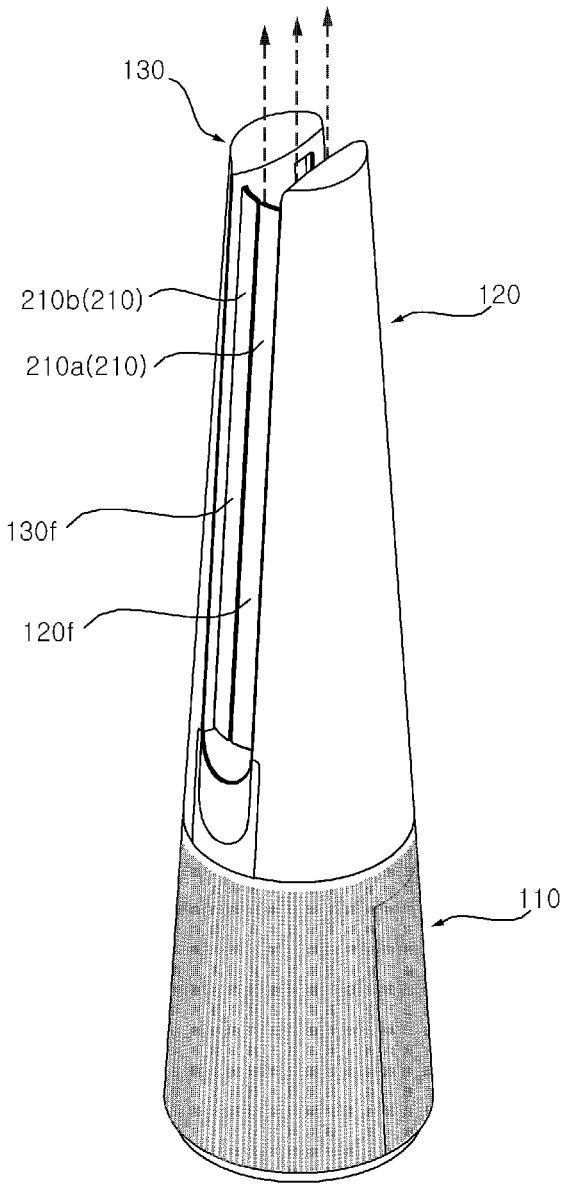

Referring to FIGS. 17 and 18, in a second state of the blower 100, a portion of the first damper 210*a* may pass through the first slot 120*h* and may be positioned in the space 109, and a portion of the second damper 210*b* may pass through the second slot 130*h* and may be positioned in the space 109. In this case, a front end 210*f* of the first damper 210*a* and a front end 210*f* of the second damper 210*b* may contact each other. Accordingly, air discharged to the space 109 in response to operation of the fan 150 (see FIG. 4) may flow forward along the boundary surfaces 121,131 of the upper bodies 120, 130, and may rise upward blocked by the first damper 210*a* and the second damper 210*b*.

The damper 210 may control a wind direction of air discharged from the blower 100 by adjusting a length of the damper 210 protruding from the slot 120*h* or a position of the front end 210*f* of the damper 210 with respect to a reference line L' extending in the frontward and rearward direction.

Figure 19:
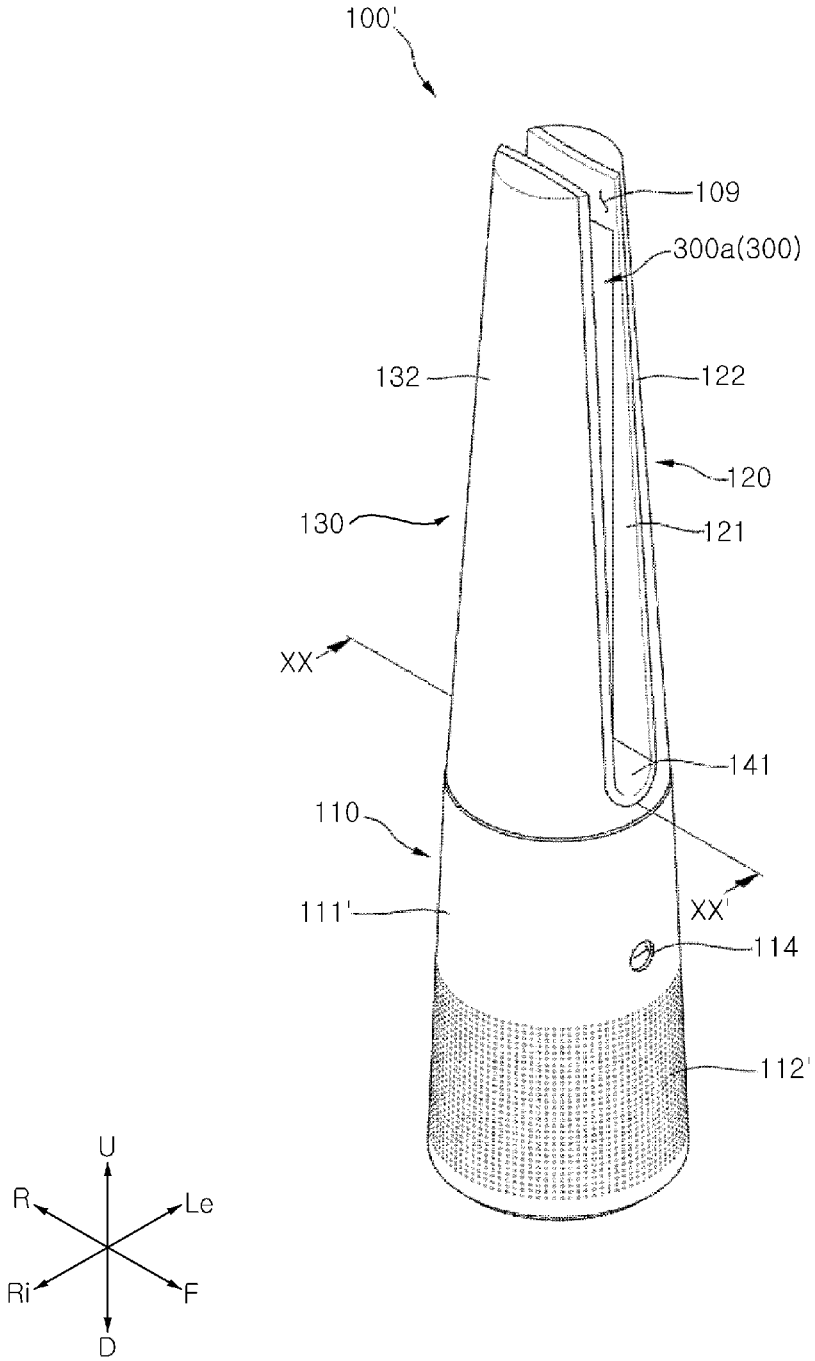
FIG. 19 is a perspective view of a blower according to another embodiment.

Referring to FIG. 19, blower 100' may have base 102, lower body 110, first upper body 120, and second upper body 130. At least one suction hole 112' may be formed to pass through a side surface of the lower body 110. A plurality of suction holes 112' may be evenly disposed along a circumferential direction of the lower body 110. A side surface 111' of the lower body 110 may include a portion at which the suction hole 112' is formed and a portion at which the suction hole 112' is not formed. For example, the portion of the lower body 110 at which the suction hole 112' is formed may be positioned under the portion at which the suction hole 112' is not formed.

A display 114 may be provided at a front of the lower body 110 and may include an interface unit that displays drive information of the blower 100' or receives a user's command. For example, the display 114 may include a touch panel.

A heater (not shown) may be installed in the inner space of the first upper body 120 and/or the second upper body 130 and may heat air flowing through the inner space of the first upper body 120 and/or the second upper body 130. For example, the heater may be a positive temperature coefficient (PTC) heater.

Figure 20:
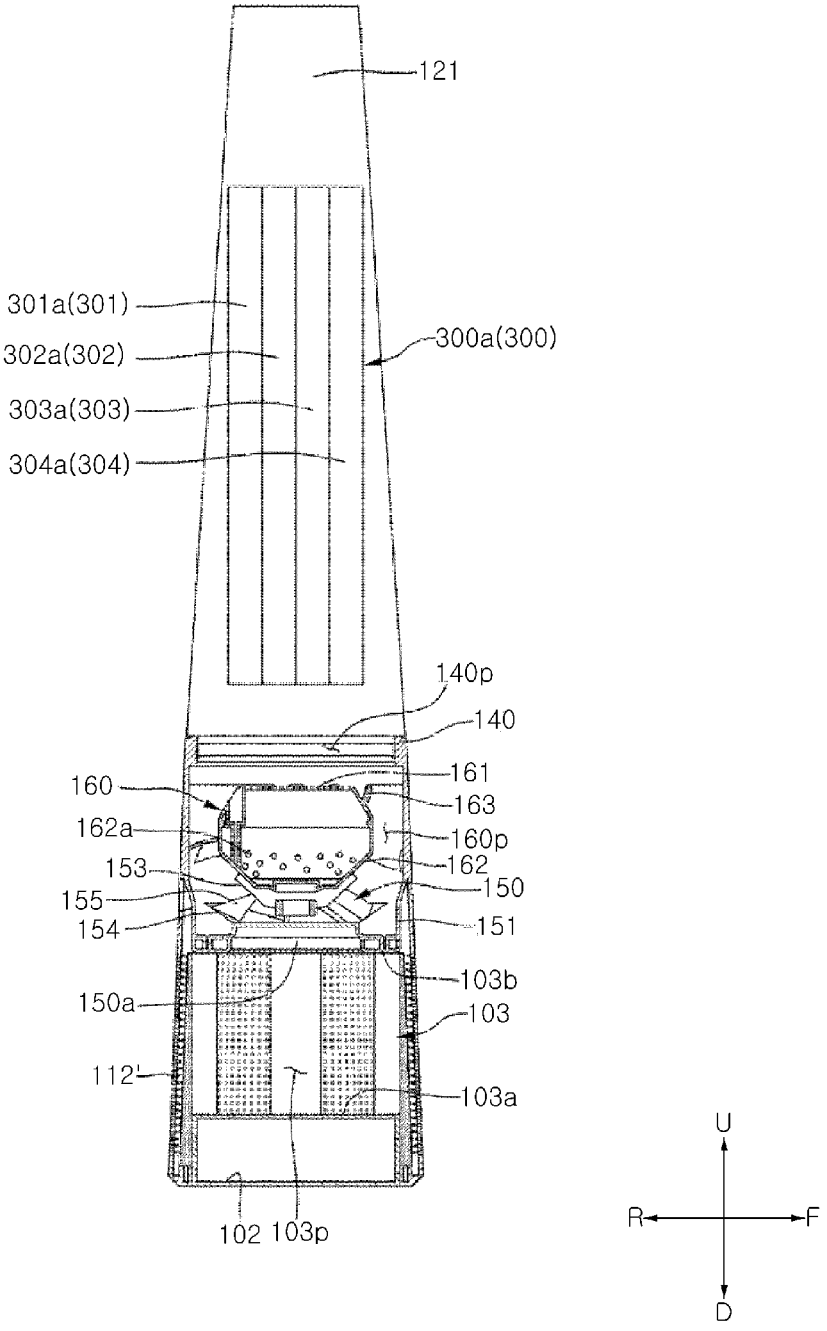
FIG. 20 is a cross-sectional view, taken along line XX-XX' of FIG. 19.

Referring to FIGS. 19 and 20, the lower body 110 may provide an inner space in which filter 103, fan 150, and air guide 160 described above with reference to FIG. 2 are installed.

A filter supporter 103*a* may be coupled to the filter 103 at a lower side of the filter 103 and may support the filter 103. For example, the filter supporter 103*a* may be formed in a ring shape. For example, a controller may be built into the filter supporter 103*a*. A filter frame 103*b* may be coupled to the filter 103 at an upper side of the filter 103. The filter frame 103*b* may provide a space in which the filter 103 is mounted.

A grill 150*a* may be disposed between the filter 103 and the fan 150. When the filter 103 is separated from the filter frame 103*b*, the grill 150*a* may block a user's finger from entering an inside of the fan 150.

Holes 162*a* may be formed at motor cover 162. A sound absorbing material (not shown) may be inserted into the holes 162*a*.

Figure 21:
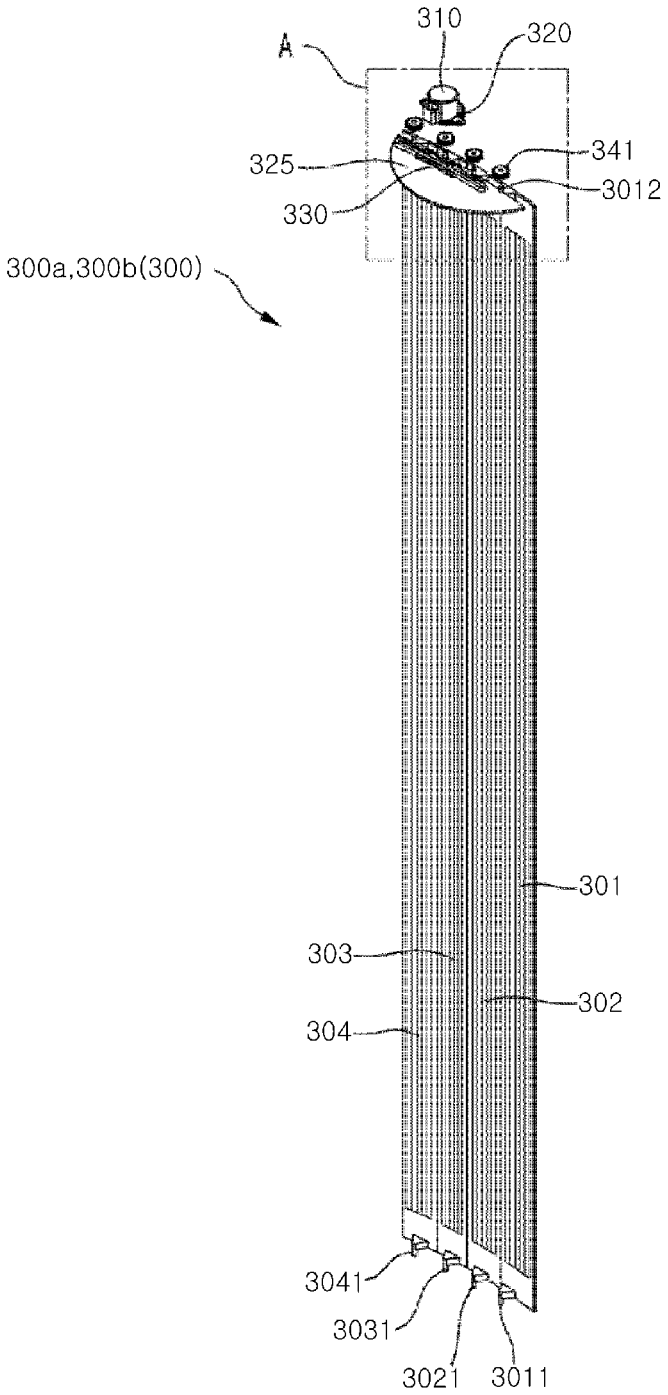
FIG. 21 is a view for explaining a door assembly of a blower of FIG. 19.
Figure 24:
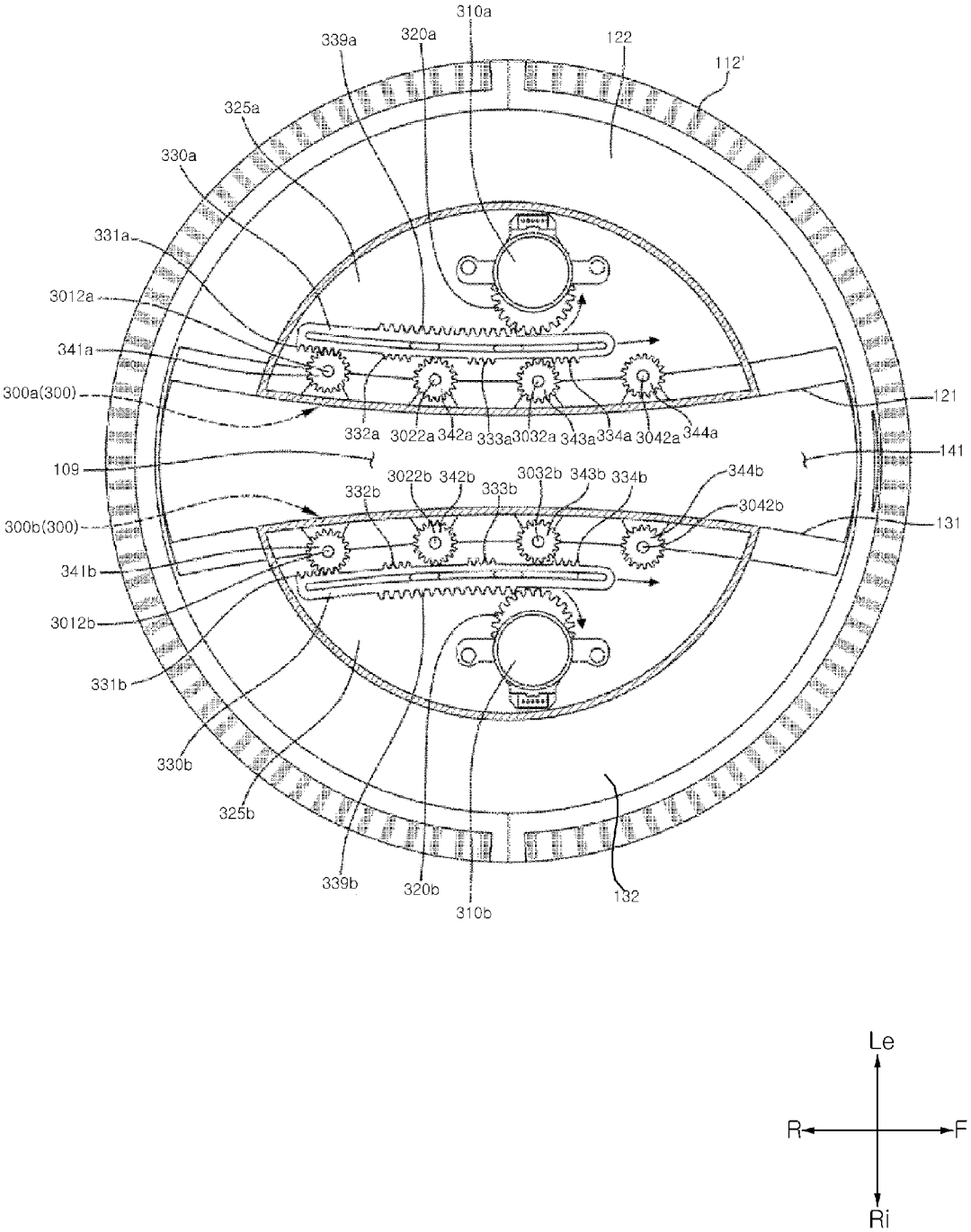
FIGS. 24 to 27 are views for explaining that blower's doors are sequentially rotated so that a blowing intensity and/or a blowing direction of the blower is gradually adjusted.

Referring to FIGS. 20, 21 and 24 the first boundary surface 121 of the first upper body 120 may face the space 109, and the second boundary surface 131 of the second upper body 130 may face the space 109. The first boundary surface 121 and the second boundary surface 131 may define a boundary of the space 109.

The first opening (no reference numeral) may be formed to pass through the first boundary surface 121. For example, the first opening may be a tetragonal hole as a whole. The first opening may be referred to as a "first hole" or a "first channel".

The second opening (no reference numeral) may be formed to pass through the second boundary surface 131. For example, the second opening may be a tetragonal hole as a whole. The second opening may be referred to as a "second hole" or a "second channel". For example, the first opening and the second opening may be symmetrical in the lateral direction.

A door assembly 300 may be installed at the first upper body 120 and the second upper body 130 and may open or close the first opening and the second opening. That is, first door assembly 300*a* may be installed at the first upper body 120 to open or close the first opening, and second door assembly 300*b* may be installed at the second upper body 130 to open or close the second opening. For example, the first door assembly 300*a* and the second door assembly 300*b* may be symmetrical in the lateral direction.

The first vane (not shown) may guide air flowing through the inner space of the first upper body 120 to the first opening. A width of the first vane may be smaller than an inner width of the first upper body 120. An end of the first vane may be adjacent to the first opening. The first vane may be formed to be curved, and a position of a front end of the first vane may be higher than a position of a rear end. For example, the first vane may be rotatable about the rear end of the first vane. For example, the first vane may include a plurality of first vanes spaced apart from each other in a vertical direction of the first upper body 120. In this case, a size of the plurality of first vanes may decrease upward.

A second vane (not shown) may guide air flowing through the inner space of the second upper body 130 to the second opening. The second vane and the first vane may be symmetrical in the lateral direction.

Figure 22:
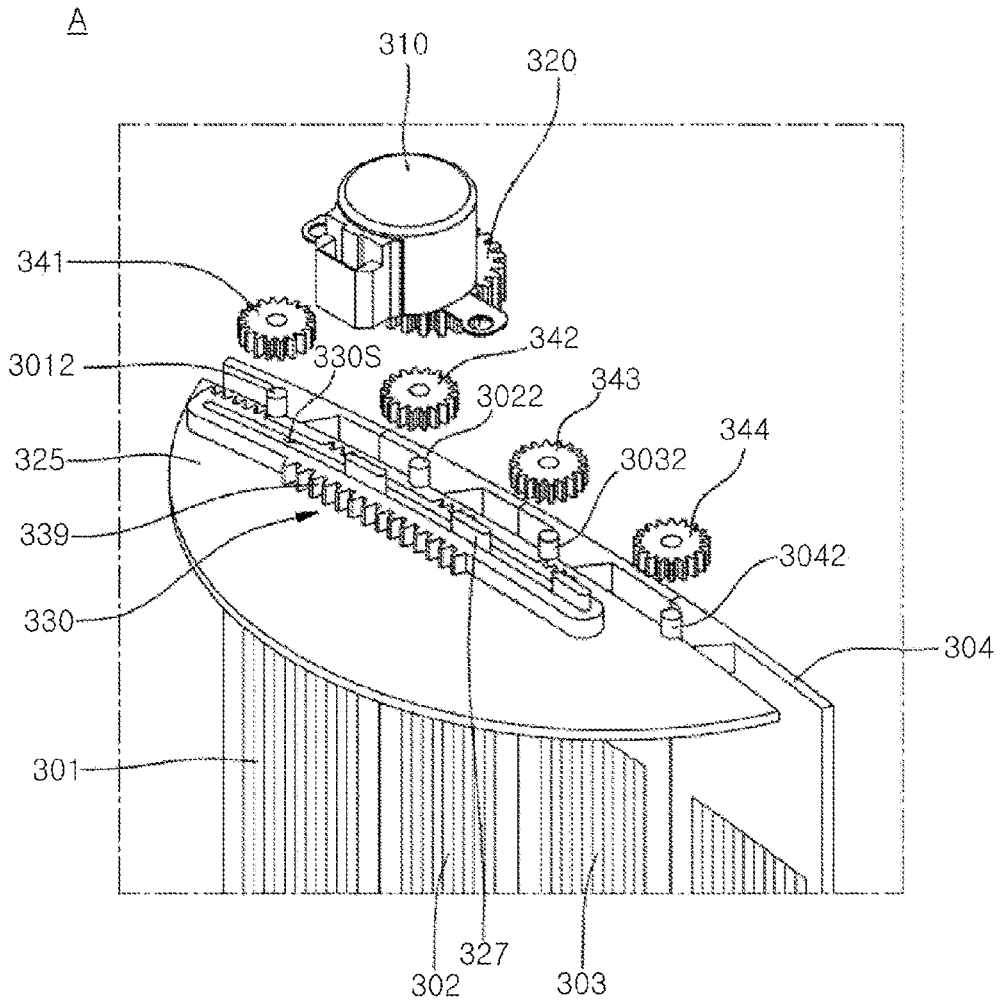
FIG. 22 is an enlarged view of portion A of FIG. 21.
Figure 23:
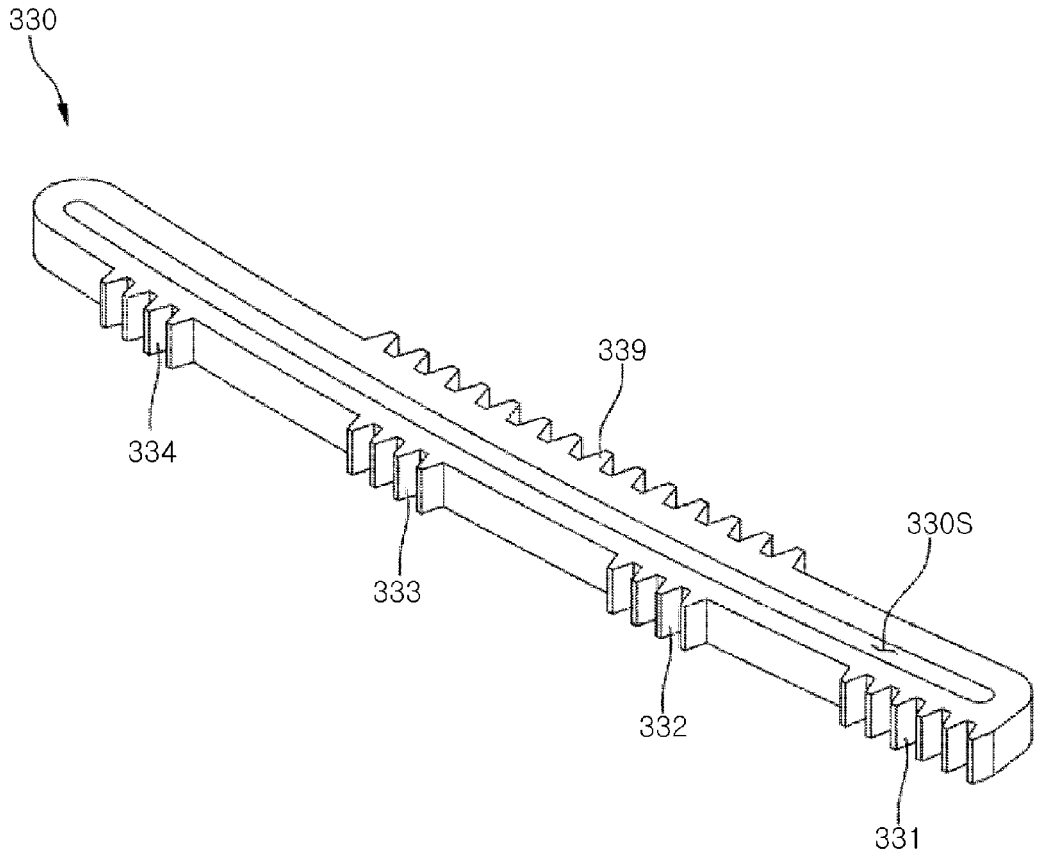
FIG. 23 is a view for explaining a moving rack of FIG. 22.

Referring to FIGS. 21 to 23, the door assembly 300 may include doors 301, 302, 303, 304, a door motor 310, a drive pinion 320, a moving rack 330, and gears 341, 342, 343, 344. The doors 301, 302, 303, 304 may open or close the first opening formed at the first boundary surface 121 (see FIG. 20) or open and close the second opening formed at the second boundary surface 131. The doors 301, 302, 303, 304 may be sequentially disposed in a widthwise direction of the first opening or a widthwise direction of the second opening from the first opening or the second opening.

An overall shape of the doors 301, 302, 303, 304 may be the same as a shape of the first opening or the second opening. For example, each of the doors 301, 302, 303, 304 may be a plate that extends lengthwise in the vertical direction and may be rotatable about each rotational axis. Each of the doors 301, 302, 303, 304 may be rotatably provided with respect to the first upper body 120 or the second upper body 130. Accordingly, the first opening or the second opening may be divided into as many spaces as the number of doors 301, 302, 303, 304 so that the divided spaces may be opened and closed independently of each other. The door may be referred to as a "door" or "a vane".

The first opening or the second opening may be opened or closed through rotation of the doors 301, 302, 303, 304. When the first opening or the second opening is closed, a side surface of the doors 301, 302, 303, 304 may contact each other, a surface of the doors 301, 302, 303, 304 toward the space 109 may be smoothly connected to the first boundary surface 121 or the second boundary surface 131. When the first opening or the second opening is opened, each of the doors 301, 302, 303, 304 may be disposed in a direction crossing the first boundary surface 121 or the second boundary surface 131.

For example, a curvature of an outer surface of the doors 301, 302, 303, 304 may be the same as a curvature of the first boundary surface 121 or the second boundary surface 131. For example, a plurality of grooves (not shown) extending lengthwise in the vertical direction may be formed at an inner surface of each of the doors 301, 302, 303, 304. The plurality of grooves may guide a rise of air flowing through the inner space of the first upper body 120 or the inner space of the second upper body 130.

For example, the doors 301, 302, 303, 304 may include first door 301, second door 302, third door 303, and fourth door 304. The first door 301 may be adjacent to the rear end 120*r* of the first upper body 120 or the rear end 130*r* of the second upper body 130, and the fourth door 304 may be adjacent to the front end 120*f* of the first upper body 120 or the front end 130*f* of the second upper body 130. The second door 302 and the third door 303 may be disposed between the first door 301 and the fourth door 304.

The second door 302 may be positioned at a rear of a center of the boundary surfaces 121 and 131 forming a width B0 of a central portion of the space 109, and the third door 303 may be positioned at a front of a center of the boundary surfaces 121 and 131 (see FIG. 7). In other words, a width of the space 109 may decrease from the first door 301 to the second door 302, and may increase from the third door 303 to the fourth door 304. In addition, each of the first door 301, the second door 302, the third door 303, and the fourth door 304 may be independently rotated about a rotational axis parallel to the vertical direction.

A first lower shaft 3011 may protrude downward from a lower end of the first door 301. A first upper shaft 3012 may protrude upward from an upper end of the first door 301. For example, the first lower shaft 3011 and the first upper shaft 3012 may be adjacent to a rear side of the first door 301. In the vertical direction, the first upper shaft 3012 may be aligned with the first lower shaft 3011. The first lower shaft 3011 and the first upper shaft 3012 may be rotatably coupled to the first upper body 120 or the second upper body 130. Accordingly, the first lower shaft 3011 and the first upper shaft 3012 may provide a rotational axis of the first door 301.

A second lower shaft 3021 may protrude downward from a lower end of the second door 302. A second upper shaft 3022 may protrude upward from an upper end of the second door 302. For example, the second lower shaft 3021 and the second upper shaft 3022 may be adjacent to a rear side of the second door 302. In the vertical direction, the second upper shaft 3022 may be aligned with the second lower shaft 3021. The second lower shaft 3021 and the second upper shaft 3022 may be rotatably coupled to the first upper body 120 or the second upper body 130. Accordingly, the second lower shaft 3021 and the second upper shaft 3022 may provide a rotational axis of the second door 302.

A third lower shaft 3031 may protrude downward from a lower end of the third door 303. A third upper shaft 3032 may protrude upward from an upper end of the third door 303. For example, the third lower shaft 3031 and the third upper shaft 3032 may be adjacent to a rear side of the third door 303. In the vertical direction, the third upper shaft 3032 may be aligned with the third lower shaft 3031. The third lower shaft 3031 and the third upper shaft 3032 may be rotatably coupled to the first upper body 120 or the second upper body 130. Accordingly, the third lower shaft 3031 and the third upper shaft 3032 may provide a rotational axis of the third door 303.

A fourth lower shaft 3041 may protrude downward from a lower end of the fourth door 304. A fourth upper shaft 3042 may protrude upward from an upper end of the fourth door 304. For example, the fourth lower shaft 3041 and the fourth upper shaft 3042 may be adjacent to a rear side of the fourth door 304. In the vertical direction, the fourth upper shaft 3042 may be aligned with the fourth lower shaft 3041. The fourth lower shaft 3041 and the fourth upper shaft 3042 may be rotatably coupled to the first upper body 120 or the second upper body 130. Accordingly, the fourth lower shaft 3041 and the fourth upper shaft 3042 may provide a rotational axis of the fourth door 304.

The first lower shaft 3011, the second lower shaft 3021, the third lower shaft 3031, and the fourth lower shaft 3041 may be spaced apart from each other in the frontward-rearward direction or a circumferential direction of the doors 301, 302, 303, 304.

The door motor 310 may provide a rotational force for the doors 301, 302, 303, 304. The door motor 310 may be a step motor capable of adjusting a rotational direction and a rotational angle.

A mount 325 may be adjacent to the upper end of the doors 301, 302, 303, 304 and may be fixed to the inner surface of the first upper body 120 or the second upper body 130. The door motor 310 may be installed on the mount 325, and a rotational shaft of the door motor 310 may extend from the door motor 310 toward the mount 325. For example, the mount 325 may be a semicircular plate. The mount 325 may divide the inner space of the first upper body 120 or the second upper body 130 into an upper space and a lower space. The lower space may be a space under the mount 325 and may provide a flow path through which air flows. The upper space may be a space above the mount 325 and may provide a space in which the door motor 310, the drive pinion 320, and the moving rack 330 are installed.

The drive pinion 320 and the moving rack 330 may be positioned at the upper space. The drive pinion 320 may be positioned under the door motor 310 and may be fixed to the rotational shaft of the door motor 310.

The moving rack 330 may be positioned on the mount 325. The moving rack 330 may be elongated lengthwise and may be engaged with the drive pinion 320. A longitudinal direction of the moving rack 330 may be parallel to the frontward-rearward direction or a circumferential direction of the doors 301, 302, 303, 304. A guide slot **330*s* may be formed to penetrate the moving rack 330 in the vertical direction, and may be formed elongated lengthwise in the longitudinal direction of the moving rack 330. A boss 327 may protrude upward from an upper surface of the mount 325 and may be inserted into the guide slot 330*s*. A length of the boss 327 may be smaller than a length of the guide slot 330*s*, and a width of the boss 327 may be the same as a width of the guide slot 330*s*. For example, the boss 327 may include a plurality of bosses spaced apart from each other in the longitudinal direction of the moving rack 330. Accordingly, the boss 327 may stably guide movement of the moving rack 330 corresponding to rotation of the drive pinion 320**.

The moving rack 330 may include a first long side and a second long side opposite to the first long side with respect to the guide slot **330*s*, a first short side connected to the first long side and the second long side, and a second short side opposite the first short side with respect to the guide slot 330*s*. The first long side may face the drive pinion 320, the second long side may face the gears 341, 342, 343, 344, and the first short side may form a rear side of the moving rack 330, and the second short side may form a front side of the moving rack 330. Accordingly, the moving rack 330 may be disposed between the gears 341, 342, 343, 344 and the drive pinion 320**.

A sliding gear 339 may be formed at the first long side and may be engaged with the drive pinion 320. The sliding gear 339 may be extend lengthwise in a longitudinal direction of the moving rack 330. A length of the sliding gear 339 may be smaller than a length of the moving rack 330. The length of the sliding gear 339 may be greater than a gap between the upper shafts 3012, 3022, 3032, 3042. The length of the sliding gear 339 may be smaller than a gap between the upper shafts 3012, 3022, 3032, 3042 which are not adjacent to each other but are spaced apart from each other. For example, the length of the sliding gear 339 may be greater than a gap between the first upper shaft 3012 and the second upper shaft 3022, but may be smaller that a gap between the first upper shaft 3012 and the third upper shaft 3032. A rear end of the sliding gear 339 may be spaced forward from the first short side, and a front end of the sliding gear 339 may be spaced rearward from the second short side. The sliding gear 339 may be referred to as a "rack gear".

The first rack gear 331, the second rack gear 332, the third rack gear 333, and the fourth rack gear 334 may be formed at the second long side and may be engaged with the gears 341, 342, 343, 344. The first rack gear 331, the second rack gear 332, the third rack gear 333, and the fourth rack gear 334 may be spaced apart from each other in the longitudinal direction of the moving rack 330. The first rack gear 331 may be adjacent to the first short side or may form a portion of the first short side. The fourth rack gear 334 may be spaced rearward from the second short side. The second rack gear 332 and the third rack gear 333 may be disposed between the first rack gear 331 and the fourth rack gear 334.

The first gear 341 may be fixed to the first upper shaft 3012 and may be engaged with or separated from the first rack gear 331. The second gear 342 may be fixed to the second upper shaft 3022 and may be engaged with or separated from the second rack gear 332. The third gear 343 may be fixed to the third upper shaft 3032 and may be engaged with or separated from the third rack gear 333. The fourth gear 344 may be fixed to the fourth upper shaft 3042 and may be engaged with or separated from the fourth rack gear 334.

In other words, a maximum rotational angle of each of the first gear 341, the second gear 342, the third gear 343, and the fourth gear 344 may be determined by a length of each of the first rack gear 331, the second rack gear 332, the third rack gear 333, and the fourth rack gear 334. The length of each of the first rack gear 331, the second rack gear 332, the third rack gear 333, and the fourth rack gear 334 may be the same as or different from each other. For example, the length of the first rack gear 331 may be a length that the first gear 341 can rotate up to 90 degrees. That is, the length of the first rack gear 331 may be the length of an arc having a central angle of 90 degrees to a radius of the first gear 341. For example, a length of each of the second rack gear 332, the third rack gear 333, and the fourth rack gear 334 may be the same as or smaller than the length of the first rack gear 331.

Accordingly, in response to forward and rearward movement of the moving rack 330, the rotational angle of the doors 301, 302, 303, 304 may be sequentially adjusted, so that an opening or closing of the first opening or the second opening or an opening degree of the first opening or the second opening may be sequentially adjusted.

Referring to FIGS. 24 to 27, a gap between rack gears 331*a*, 332*a*, 333*a*, 334*a* of the first door assembly 300*a* may be smaller than a gap between the upper shafts 3012*a*, 3022*a*, 3032*a*, 3042*a*. Accordingly, when any one of the gears 341*a*, 342*a*, 343*a*, 344*a* of the first door assembly 300*a* rotates in engagement with any one of the rack gears 331*a*, 332*a*, 333*a*, 334*a*, any one of the doors 301*a*, 302*a*, 303*a*, 304*a* may rotate to open or close a portion of the first opening.

That is, the moving rack 330*a* of the first door assembly 300*a* may be engaged sequentially with the first gear 341*a*, the second gear 342*a*, the third gear 343*a*, and the fourth gear 344*a* to correspond to the rotation of the door motor 310*a*. For example, in response to forward movement of the moving rack 330*a*, after the first gear 341*a* engaged with the first rack gear 331*a* is separated from the first rack gear 331*a*, the second gear 342*a* may be engaged with the second rack gear 332*a*. In response to forward movement of the moving rack 330*a*, after the second gear 342*a* engaged with the second rack gear 332*a* is separated from the second rack gear 332*a*, the third gear 343*a* may be meshed with the third rack gear 333*a*. In addition, in response to forward movement of the moving rack 330*a*, after the third gear 343*a* engaged with the third rack gear 333*a* is separated from the third rack gear 333*a*, the fourth gear 344*a* may be engaged with the fourth rack gear 334*a*. For another example, in response to forward movement of the moving rack 330*a*, at least two of the gears 341*a*, 342*a*, 343*a*, 344*a* may rotate in engaging with matching rack gears 331*a*, 332*a*, 333*a*, 334*a*.

A gap between rack gears 331*b*, 332*b*, 333*b*, 334*b* of the second door assembly 300*b* may be smaller than a gap between upper shafts 3012*b*, 3022*b*, 3032*b*, 3042*b*. Accordingly, when any one of the gears 341*b*, 342*b*, 343*b*, 344*b* of the second door assembly 300*b* rotates in engagement with any one of the rack gears 331*b*, 332*b*, 333*b*, 334*b*, any one of the doors 301*b*, 302*b*, 303*b*, 304*b* may rotate to open or close a portion of the second opening.

That is, the moving rack 330*b* of the second door assembly 300*b* may be engaged sequentially with the first gear 341*b*, the second gear 342*b*, the third gear 343*b*, and the fourth gear 344*b* to correspond to rotation of the door motor 310*b*. For example, in response to forward movement of the moving rack 330*b*, after the first gear 341*b* engaged with the first rack gear 331*b* is separated from the first rack gear 331*b*, the second gear 342*b* may be engaged with the second rack gear 332*b*. In response to forward movement of the moving rack 330*b*, after the second gear 342*b* engaged with the second rack gear 332*b* is separated from the second rack gear 332*b*, the third gear 343*b* may be engaged with the third rack gear 333*b*. In addition, in response to forward movement of the moving rack 330*b*, after the third gear 343*b* engaged with the third rack gear 333*b* is separated from the third rack gear 333*b*, the fourth gear 344*b* may be engaged with the fourth rack gear 334*b*. For another example, in response to forward movement of the moving rack 330*b*, at least two of the gears 341*b*, 342*b*, 343*b*, 344*b* may rotate in engaging with matching rack gears 331*b*, 332*b*, 333*b*, 334*b*.

For example, the first door assembly 300*a* and the second door assembly 300*b* may be symmetrical in the lateral direction.

The controller (not shown) may control operation of the door motor 310*a* of the first door assembly 300*a* and the door motor 310*b* of the second door assembly 300*b* to adjust opening or closing and an opening degree of the first and second openings. The controller may rotate the door motor 310*a* of the first door assembly 300*a* in a first direction to move the moving rack 330*a* forward, and may rotate the door motor 310*b* of the second door assembly 300*b* in a second direction opposite to the first direction to move the moving rack 330*b* forward. The controller may rotate the door motor 310*a* of the first door assembly 300*a* in the second direction to move the moving rack 330*a* rearward, and may rotate the door motor 310*b* of the second door assembly 300*b* in the first direction to move the moving rack 330*b* rearward. The controller may synchronize a rotational angle or rotational speed of the door motor 310*a* of the first door assembly 300*a* and a rotational angle or rotational speed of the door motor 310*b* of the second door assembly 300*b*.

Referring to FIG. 24, the doors 301*a*, 302*a*, 303*a*, 304*a* of the first door assembly 300*a* may close the first opening, and the doors 301*b*, 302*b*, 303*b* of the second door assembly 300*b*, 304*b*) may close the second opening. The moving rack 330*a* of the first door assembly 300*a* may be positioned at a rearmost position, and the first gear 341*a* may be engaged with the first rack gear 331*a*. The moving rack 330*b* of the second door assembly 300*b* may be positioned at a rearmost position, and the first gear 341*b* may be engaged with the first rack gear 331*b*. The controller may close the first opening and the second opening in a blower stop or standby mode.

Figure 25:
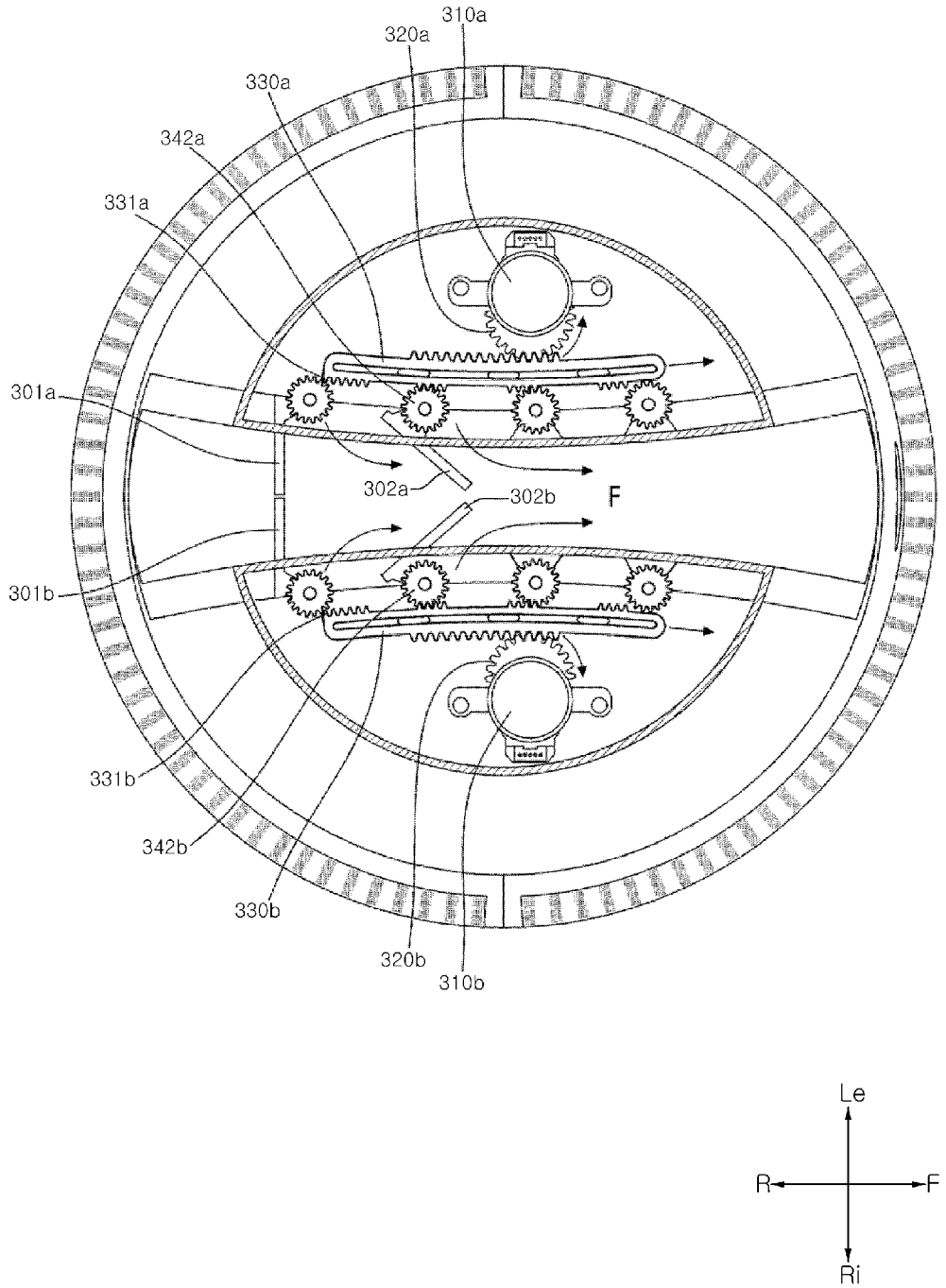

Referring to FIG. 25, in response to forward movement of the moving rack 330*a* of the first door assembly 300*a*, the first gear 341*a* may rotate in engagement with the first rack gear 331*a*, and the second gear 342*a* may rotate in engagement with the second rack gear 332*a*. A rotational angle of the second gear 342*a* may be smaller than a rotational angle of the first gear 341*a*. That is, when the first rack gear 331*a* is separated from the first gear 341*a*, the first gear 341*a* may be in a state in which it is rotated a maximum rotational angle, for example 90 degrees, and the second gear 342*a* may be a state in which it is rotated an angle, for example, 45 degrees, smaller than the maximum rotational angle, and the third gear 343*a* may be in a state in which it starts to engage with the third rack gear 333*a*.

In response to forward movement of the moving rack 330*b* of the second door assembly 300*b*, the first gear 341*b* may rotate in engagement with the first rack gear 331*b*, and the second gear 342*b* may rotate in engagement with the second rack gear 332*b*. A rotational angle of the second gear 342*b* may be smaller than a rotational angle of the first gear 341*b*. That is, when the first rack gear 331*b* is separated from the first gear 341*b*, the first gear 341*b* may be in a state in which it is rotated a maximum rotational angle, for example, 90 degrees, and the second gear 342*b* may be a state in which it is rotated an angle, for example, 45 degrees, less than the maximum rotational angle, and the third gear 343*b* may be in a state in which it starts to engage with the third rack gear 333*b*.

In a first blower mode, the controller may rotate the first door 301*a* of the first door assembly 300*a* and the first door 301*b* of the second door assembly 300*b* a maximum rotational angle. In this case, a portion corresponding to the first door 301*a* of the first opening and a portion corresponding to the first door 301*b* of the second opening may be fully opened toward the space 109. A portion corresponding to the second door 302*a* of the first opening and a portion corresponding to the second door 302*b* of the second opening may be inclined toward a front of the space 109.

Accordingly, in the first blower mode, air discharged to the space 109 from the portion corresponding to the first door 301*a* of the first opening and the portion corresponding to the first door 301*b* of the second opening may flow forward, and may be accelerated by a venturi effect while passing between the second doors 302*a* and 302*b*. The accelerated air may be mixed with air discharged from a portion corresponding to the second door 302*a* of the first opening and a portion corresponding to the second door 302*b* of the second opening, and may flow forward along the first boundary surface 121 and the second boundary surface 131 and may diffuse in the lateral direction (see F of FIG. 25).

Figure 26:
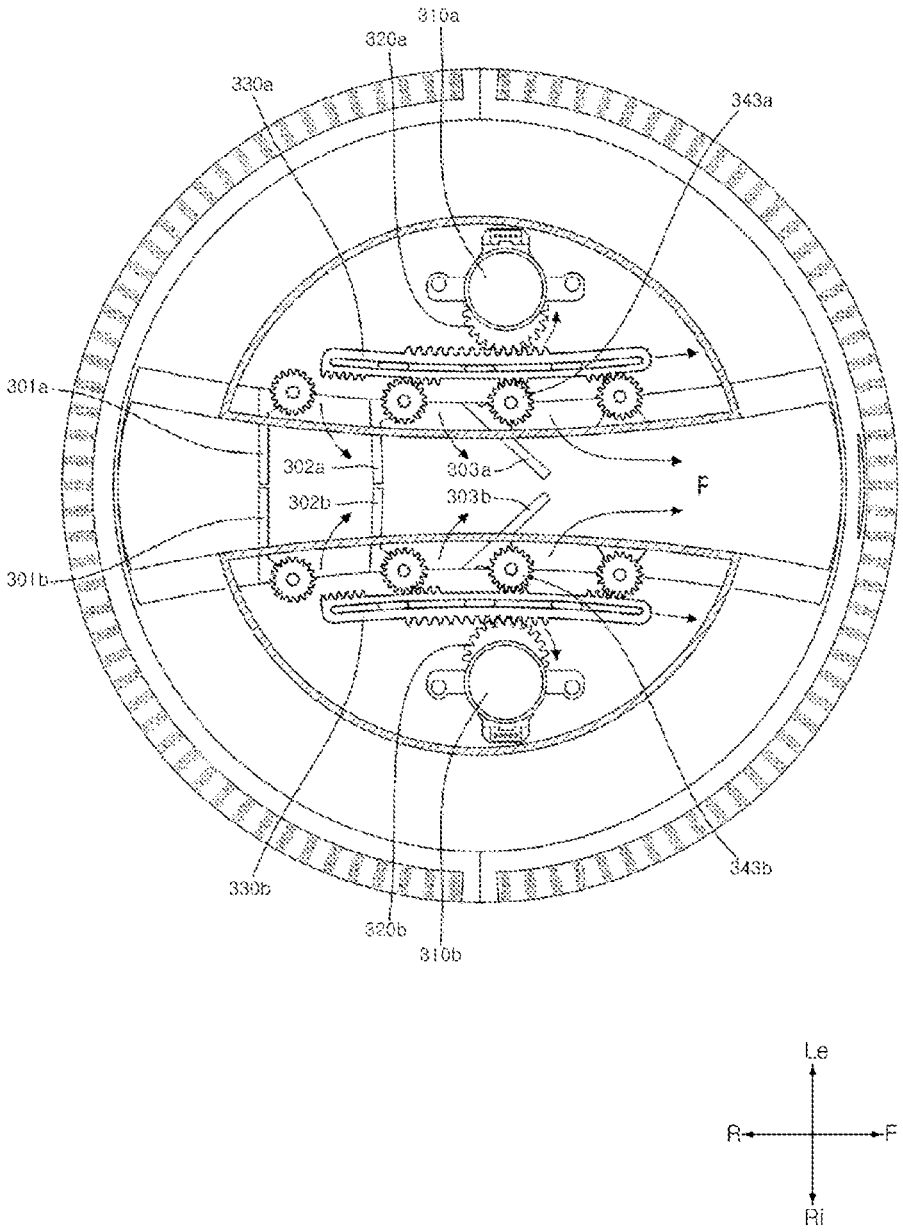

Referring to FIG. 26, in response to forward movement of the moving rack 330*a* of the first door assembly 300*a*, the second gear 342*a* may rotate in engagement with the second rack gear 332*a*, and the third gear 343*a* may rotate in engagement with the third rack gear 333*a*. A rotational angle of the third gear 343*a* may be smaller than a rotational angle of the second gear 342*a*. That is, when the second rack gear 332*a* is separated from the second gear 342*a*, the second gear 342*a* may be in a state in which it is rotated a maximum rotational angle, for example, 90 degrees, and the third gear 343*a* may be a state in which it is rotated an angle, for example, 45 degrees, smaller than the maximum rotational angle, and the fourth gear 344*a* may be in a state in which it starts to engage with the fourth rack gear 334*a*.

In response to forward movement of the moving rack 330*b* of the second door assembly 300*b*, the second gear 342*b* may rotate in engagement with the second rack gear 332*b*, and the third gear 343*b* may rotate in engagement with the third rack gear 333*b*. A rotational angle of the third gear 343*b* may be smaller than a rotational angle of the second gear 342*b*. That is, when the second rack gear 332*b* is separated from the second gear 342*b*, the second gear 342*b* may be in a state in which it is rotated a maximum rotational angle, for example, 90 degrees, and the third gear 343*b* may be a state in which it is rotated an angle, for example, 45 degrees smaller than the maximum rotational angle, and the fourth gear 344*b* may be in a state in which it starts to engage with the fourth rack gear 334*b*.

In a second blower mode, the controller may rotate the first door 301*a* and the second door 302*a* of the first door assembly 300*a* and the first door 301*b* and the second door 302*b* of the second door assembly 300*b* a maximum rotational angle. In this case, a portion corresponding to the first door 301*a* and the second door 302*a* of the first opening and a portion corresponding to the first door 301*b* and the second door 302*b* of the second opening may be fully opened toward the space 109. The portion corresponding to the third door 303*a* of the first opening and the portion corresponding to the third door 303*b* of the second opening may be inclined toward a front of the space 109. In this case, the third doors 303*a*, 303*b* may be positioned in front of the second doors 302*a*, 302*b*. That is, compared with the first blower mode, airflow formed by the blower in the second blower mode may be strong and be concentrated in the center (see F of FIG. 26).

Figure 27:
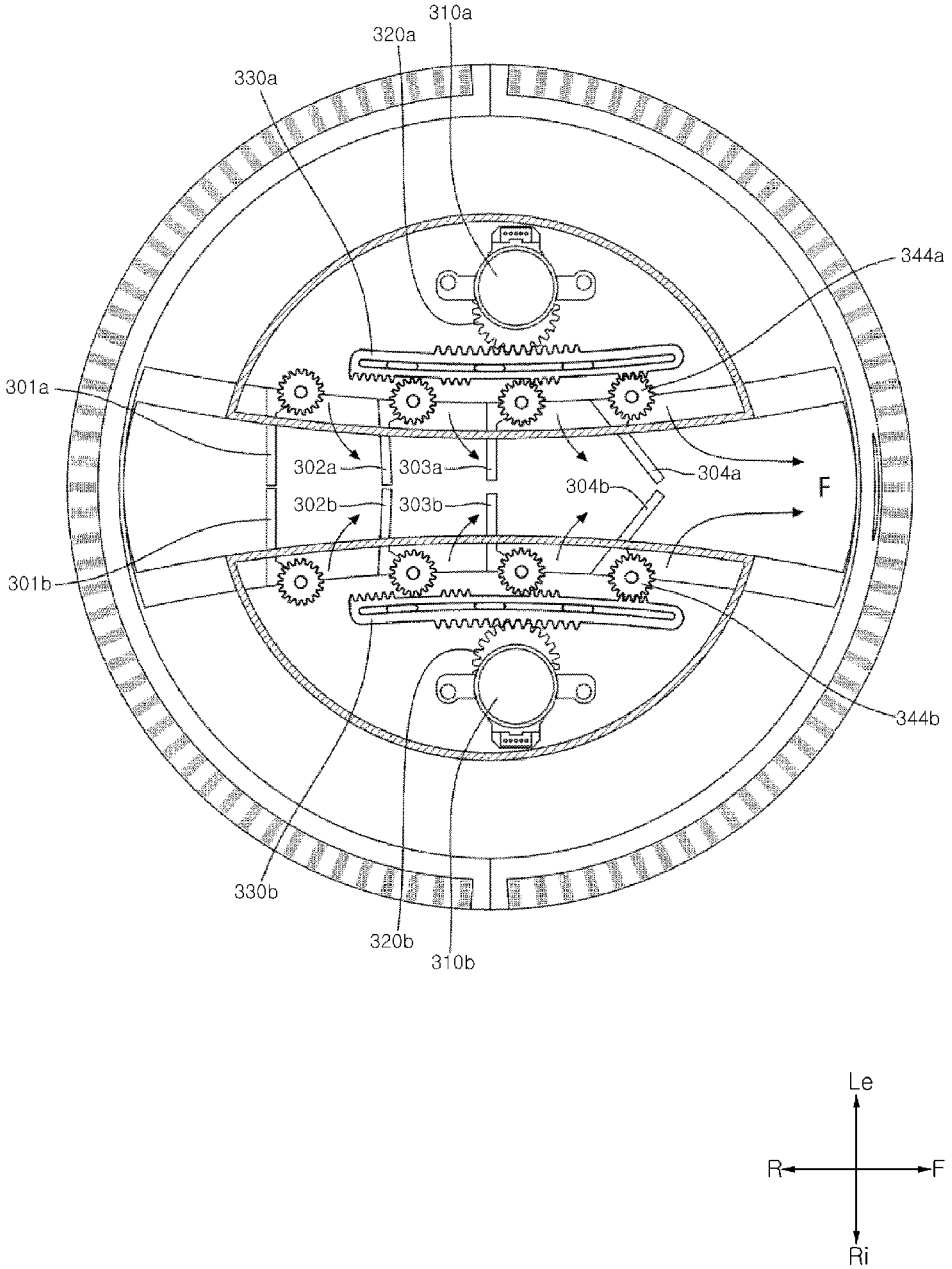

Referring to FIG. 27, in response to forward movement of the moving rack 330*a* of the first door assembly 300*a*, the third gear 343*a* may rotate in engagement with the third rack gear 333*a*, and the fourth gear 344*a* may rotate in engagement with the fourth rack gear 334*a*. A rotational angle of the fourth gear 344*a* may be smaller than a rotational angle of the third gear 343*a*. That is, when the third rack gear 333*a* is separated from the third gear 343*a*, the third gear 343*a* may be in a state in which it is rotated a maximum rotational angle, for example, 90 degrees, and the fourth gear 344*a* may be a state in which it is rotated an angle, for example, 45 degrees, smaller than the maximum rotational angle.

In response to forward movement of the moving rack 330*b* of the second door assembly 300*b*, the third gear 343*b* may rotate in engagement with the third rack gear 333*b*, and the fourth gear 344*b* may rotate in engagement with the fourth rack gear 334*b*. A rotational angle of the fourth gear 344*b* may be smaller than a rotational angle of the third gear 343*b*. That is, when the third rack gear 333*b* is separated from the third gear 343*b*, the third gear 343*b* may be in a state in which it is rotated a maximum rotational angle, for example, 90 degrees, and the fourth gear 344*b* may be a state in which it is rotated an angle, for example, 45 degrees, smaller than the maximum rotational angle.

In a third blower mode, the controller may rotate the first door 301*a*, the second door 302*a* and the third door 303*a* of the first door assembly 300*a* and the first door 301*b*, the second door 302*b* and the third door 303*b* of the second door assembly 300*b* a maximum rotational angle. In this case, a portion corresponding to the first door 301*a*, the second door 302*a*, and the third door 303*a* of the first opening and a portion corresponding to the first door 301*b*, the second door 302*b*, and the third door 303*b* of the second opening may be fully opened toward the space 109. The portion corresponding to the fourth door 304*a* of the first opening and the portion corresponding to the fourth door 304*b* of the second opening may be inclined toward a front of the space 109.

In this case, the fourth doors 304*a*, 304*b* may be positioned in front of the third doors 303*a*, 303*b*. That is, compared to the second blower mode, airflow formed by the blower in the third blower mode may be stronger and be concentrated more in the center (see F of FIG. 27).

On the other hand, based on a description of rotation of the doors 301, 302, 303, 304 corresponding to the forward movement of the moving rack 330 and an opening of the first and second openings, reverse rotation of the doors 301, 302, 303, 304 corresponding to rearward movement of moving rack 330 and closing of the first and second openings may be understood.

Referring to FIGS. 24 to 27, the doors 301*a*, 302*a*, 303*a*, 304*a* of the first door assembly 300*a* and the doors 301*b*, 302*b*, 303*b*, 304*b* of the second door assembly 300*b* may contact each other or be adjacent to each other in a rotating state to the maximum rotational angle.

The first door 301*a* rotated the maximum rotational angle of the first door assembly 300*a* may contact or be adjacent to the first door 301*b* rotated the maximum rotational angle of the second door assembly 300*b*. The second door 302*a* rotated the maximum rotational angle of the first door assembly 300*a* may contact or be adjacent to the second door 302*b* rotated the maximum rotational angle of the second door assembly 300*b*. In this case, an increased wind may be formed between the first doors 301*a*, 301*b* and the second doors 302*a*, 302*b* (see FIG. 26).

The third door 303*a* rotated the maximum rotational angle of the first door assembly 300*a* may contact or be adjacent to the third door 303*b* rotated the maximum rotational angle of the second door assembly 300*b*. In this case, increased wind may be formed between the first doors 301*a*, 301*b* and the second doors 302*a*, 302*b*, and between the second doors 302*a*, 302*b* and the third doors 303*a*, 303*b* (see FIG. 27).

The fourth door 304*a* rotated at maximum rotational angle of the first door assembly 300*a* may contact or be adjacent to the fourth door 304*b* rotated the maximum rotational angle of the second door assembly 300*b*. In this case, increased wind may be formed between the first doors 301*a*, 301*b* and the second doors 302*a*, 302*b*, between the second doors 302*a*, 302*b* and the third doors 303*a*, 303*b*, and between the third doors 303*a*, 303*b*, and the fourth doors 304*a* and 304*b*.

The blower according to embodiments disclosed herein has at least the following advantages.

According to embodiments disclosed herein, a blower capable of blowing air using the coanda effect may be provided. Further, according to embodiments disclosed herein, a blower capable of step by step opening or closing an opening for discharging air using doors may be provided. Furthermore, according to embodiments disclosed herein, a blower capable of step by step adjusting a blowing intensity and/or a blowing direction by controlling a rotational angle of doors may be provided. Also, according to embodiments disclosed herein, a structure capable of sequentially rotating doors through a single motor may be provided.

Embodiments disclosed herein solve the above and other problems.

Embodiments disclosed herein provide a blower capable of blowing air using a coanda effect. Embodiments disclosed herein further provide a blower capable of step by step opening and closing an opening through which air is discharged using doors. Embodiments disclosed herein furthermore provide a blower capable of controlling a blowing intensity and/or a blowing direction by adjusting a rotational angle of the doors. Embodiments disclosed herein provide a structure capable of rotating doors through a single motor sequentially.

Embodiments disclosed herein provide a blower that may include a fan that creates airflow; a lower body forming an inner space in which the fan may be installed, and having at least one suction hole through which air passes; an upper body positioned above the lower body and including a first upper body forming a first inner space communicating with the inner space of the lower body, and a second upper body forming a second inner space communicating with the inner space of the lower body and spaced apart from the first upper body; a space formed between the first upper body and the second upper body and opened in a frontward-rearward direction; a first opening formed through a first boundary surface of the first upper body facing the space; a second opening formed through a second boundary surface of the second upper body facing the space; and a door assembly including a first door installed at the first upper body and that opens or closes the first opening, and a second door installed at the second upper body and opens or closes the second opening.

The first door may include a plurality of first doors sequentially disposed in a widthwise direction of the first opening at the first opening, the first opening may be divided into a plurality of first regions, each of which is opened or closed corresponding to each of the plurality of first doors. The second door may include a plurality of second doors sequentially disposed in a widthwise direction of the second opening at the second opening, and the second opening may be divided into a plurality of second regions, each of which is opened or closed corresponding to each of the plurality of second doors.

The first upper body may be spaced from the second upper body in a leftward or lateral direction. The first opening and the second opening may be symmetrical in a left-right or lateral direction. The door assembly may include a first door assembly including the plurality of first doors, and a second door assembly including the plurality of second doors. The first door assembly and the second door assembly may be symmetrical in the left-right direction.

Each of the first door assembly and the second door assembly may further include a door motor that provides rotational force; a drive pinion fixed to a rotational shaft of the door motor; a moving rack that extends lengthwise and is engaged with the drive pinion; and a plurality of gears engaged with the moving rack. Each of the plurality of the gears of the first door assembly may provide a rotational shaft of each of the plurality of first doors, and each of the plurality of the gears of the second door assembly may provide a rotational shaft of each of the plurality of second doors.

The moving rack may be disposed between the plurality of gears and the drive pinion, and engaged with the plurality of gears and the drive pinion. The moving rack may further include a first long side that extends in a longitudinal direction of the moving rack, and facing the drive pinion; a second long side opposite to the first long side, and facing the plurality of gears; a sliding gear formed at the first long side, and engaged with the drive pinion; and a plurality of rack gears formed at the second long side, spaced apart from each other in the longitudinal direction of the moving rack, and engaged with the plurality of the gears. A length of the sliding gear may be larger than a gap between rotational shafts of the plurality of gears, but smaller than a gap between the rotational shafts of the plurality of gears that are not adjacent to each other but are spaced apart from each other.

Each of the plurality of rack gears may be matched or correspond to each of the plurality of gears. A length of a first rack gear, which is any one of the plurality of rack gears, may be a length of an arc of a predetermined central angle with respect to a radius of a first gear, which is any one of the plurality of gears, and the first gear may be matched to the first rack gear.

The first door assembly may further include a mount installed at the first inner space, positioned under the door mount and supporting the door motor. The moving rack of the first door assembly may be coupled to an upper surface of the mount to be movable in a longitudinal direction of the moving rack.

The moving rack of the first door assembly may further include a guide slot formed through the moving rack in an up-down (vertical) direction, and formed elongated in a longitudinal direction of the moving rack. The mount of the first door assembly may further includes a boss protruding upward from an upper surface of the mount and inserted into the guide slot.

The first door assembly may further include a plurality of upper shafts, each of which may protrude upward from an upper end of each of the plurality of first doors and be fixed to each of the plurality of gears, and the plurality of upper shafts may be spaced apart from each other in a longitudinal direction of the moving rack and rotatably coupled to the first upper body. The first door assembly may further include a plurality of lower shafts, each of which may protrude downward from a lower end of each of the plurality of first doors and be rotatably coupled to the first upper body, and the plurality of lower shafts may be aligned with the plurality of upper shafts in the up-down direction.

The first upper body may be spaced from the second upper body in a left (first lateral) direction, the first boundary surface may be convex in a right (second lateral) direction, the second boundary surface may be convex in the left direction, and a gap between the first boundary surface and the second boundary surface may decrease from a rear of the space to a center of the space and increase from the center of the space to a front of the space. The plurality of first doors may be disposed symmetrically with respect to a center of the first boundary surface in the frontward-rearward direction.

When the first opening is closed, the plurality of first doors may be disposed parallel to the first boundary surface. When the first opening is open, the plurality of first doors may cross the first boundary surface. When the first opening and the second opening are open, the plurality of first doors and the plurality of second doors may be in contact with or adjacent to each other.

The door assembly may further include a door motor that supplies power to the plurality of first doors and the plurality of second doors. The blower further may include a control unit (controller) that controls an operation of the door motor to open or close the plurality of first regions and the plurality of second regions.

The control unit may sequentially open or close the plurality of first regions through the plurality of first doors, or sequentially open or close the plurality of second regions through the plurality of second doors. The plurality of first doors may be disposed sequentially in the frontward-rearward direction, and be rotatable about a rotational shaft parallel to the upward-downward direction. The plurality of second doors may be disposed sequentially in the frontward-rearward direction, and be rotatable about a rotational shaft parallel to the upward-downward direction. The control unit may sequentially rotate the plurality of first doors and the plurality of second doors in the frontward-rearward direction.

Certain embodiments or other embodiments described above are not mutually exclusive or distinct from each other. Any or all elements of the embodiments described above may be combined or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a fan that creates airflow;

a lower body forming an inner space in which the fan is installed, and having at least one suction hole through which air passes;

an upper body positioned above the lower body and including a first upper body forming a first inner space that communicates with the inner space of the lower body, and a second upper body forming a second inner space that communicates with the inner space of the lower body and spaced apart from the first upper body;

a space formed between the first upper body and the second upper body and opened in a frontward-rearward direction;

a first opening formed through a first boundary surface of the first upper body facing the space;

a second opening formed through a second boundary surface of the second upper body facing the space; and a door assembly including a first door installed at the first upper body and that opens and closes the first opening, and a second door installed at the second upper body and that opens and closes the second opening.

2. The blower according to claim 1, wherein the first door comprises a plurality of first doors sequentially disposed at the first opening in a widthwise direction of the first opening, wherein the first opening is divided into a plurality of first regions, each of which is opened or closed corresponding to each of the plurality of first doors, wherein the second door comprises a plurality of second doors sequentially disposed at the second opening in a widthwise direction of the second opening, and wherein the second opening is divided into a plurality of second regions, each of which is opened or closed corresponding to each of the plurality of second doors.

3. The blower according to claim 2, wherein the first upper body is spaced from the second upper body in a lateral direction, wherein the first opening and the second opening are symmetrical in the lateral direction, and wherein the door assembly comprises:

a first door assembly including the plurality of first doors; and a second door assembly including the plurality of second doors.

4. The blower according to claim 3, wherein the first door assembly and the second door assembly are symmetrical in the lateral direction.

5. The blower according to claim 3, wherein each of the first door assembly and the second door assembly further comprises:

a door motor that provides a rotational force;

a drive pinion fixed to a rotational shaft of the door motor;

a moving rack that extends lengthwise and is engaged with the drive pinion; and a plurality of gears engaged with the moving rack, wherein each of the plurality of gears of the first door assembly provides a rotational shaft of each of the plurality of first doors, and wherein each of the plurality of gears of the second door assembly provides a rotational shaft of each of the plurality of second doors.

6. The blower according to claim 5, wherein the moving rack is disposed between the plurality of gears and the drive pinion, and engaged with the plurality of gears and the drive pinion.

7. The blower according to claim 6, wherein the moving rack further comprises:

a first long side extending in a longitudinal direction of the moving rack, and facing the drive pinion;

a second long side opposite to the first long side, and facing the plurality of gears;

a sliding gear formed at the first long side, and engaged with the drive pinion; and a plurality of rack gears formed at the second long side, spaced apart from each other in the longitudinal direction of the moving rack, and engaged with the plurality of gears.

8. The blower according to claim 7, wherein a length of the sliding gear is larger than a gap between rotational shafts of the plurality of gears, but smaller than a gap between the rotational shafts of the plurality of gears that are not adjacent to each other but are spaced apart from each other.

9. The blower according to claim 8, wherein the plurality of rack gears is matched to the plurality of gears, respectively, wherein a length of a first rack gear, which is any one of the plurality of rack gears is a length of an arc of a central angle with respect to a radius of a first gear, which is any one of the plurality of gears, and wherein the first gear is matched to the first rack gear.

10. The blower according to claim 5, wherein the first door assembly further comprises a mount installed at the first inner space, positioned under the door motor and supporting the door motor, and wherein the moving rack of the first door assembly is coupled to an upper surface of the mount to be movable in a longitudinal direction of the moving rack.

11. The blower according to claim 10, wherein the moving rack of the first door assembly further comprises a guide slot formed through the moving rack in a vertical direction and extending lengthwise in the longitudinal direction of the moving rack, and wherein the mount of the first door assembly further comprises a boss that protrudes upward from the upper surface of the mount and inserted into the guide slot.

12. The blower according to claim 5, wherein the first door assembly further comprises a plurality of upper shafts, the plural of upper shafts protruding upward from an upper end of the plurality of first doors, respectively, and fixed to the plurality of gears, respectively, and wherein the plurality of upper shafts is spaced apart from each other in a longitudinal direction of the moving rack and rotatably coupled to the first upper body.

13. The blower according to claim 12, wherein the first door assembly further comprises a plurality of lower shafts, the plurality of lower shafts protruding downward from a lower end of the plurality of first doors, respectively, and rotatably coupled to the first upper body, respectively, and wherein the plurality of lower shafts is aligned with the plurality of upper shafts in a vertical direction.

14. The blower according to claim 2, wherein the first upper body is spaced from the second upper body in a first lateral direction, wherein the first boundary surface is convex in a second lateral direction, wherein the second boundary surface is convex in the first lateral direction, and wherein a gap between the first boundary surface and the second boundary surface decreases from a rear of the space to a center of the space and increases from the center of the space to a front of the space.

15. The blower according to claim 14, wherein the plurality of first doors is disposed symmetrically with respect to a center of the first boundary surface in the frontward-rearward direction.

16. The blower according to claim 2, wherein when the first opening is closed, the plurality of first doors is disposed parallel to the first boundary surface, and wherein when the first opening is open, the plurality of first doors crosses the first boundary surface.

17. The blower according to claim 16, wherein when the first opening and the second opening are open, the plurality of first doors and the plurality of second doors are in contact with or adjacent to each other.

18. The blower according to claim 2, wherein the door assembly further comprises a door motor that supplies power to the plurality of first doors and the plurality of second doors, and wherein the blower further comprises a controller that controls operation of the door motor to open and close the plurality of first regions and the plurality of second regions.

19. The blower according to claim 18, wherein the controller sequentially opens and closes the plurality of first regions through the plurality of first doors, or sequentially opens and closes the plurality of second regions through the plurality of second doors.

20. The blower according to claim 19, wherein the plurality of first doors is disposed sequentially in the frontward-rearward direction, and are rotatable about a rotational shaft parallel to a vertical direction, wherein the plurality of second doors is disposed sequentially in the frontward-rearward direction, and is rotatable about a rotational shaft parallel to the vertical direction, and wherein the controller sequentially rotates the plurality of first doors and the plurality of second doors in the frontward-rearward direction.

* * * * *